US007452847B2

(12) United States Patent
Kuboyama et al.

(10) Patent No.: US 7,452,847 B2
(45) Date of Patent: Nov. 18, 2008

(54) REVERSIBLE THERMOSENSITIVE RECORDING MEDIUM, REVERSIBLE THERMOSENSITIVE RECORDING LABEL, REVERSIBLE THERMOSENSITIVE RECORDING DEVICE, IMAGE PROCESSING APPARATUS, AND IMAGE PROCESSING METHOD

(75) Inventors: Hiroki Kuboyama, Mishima (JP); Satoshi Arai, Numazu (JP); Tadafumi Tatewaki, Shizuoka-ken (JP); Satoru Sampei, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 370 days.

(21) Appl. No.: 11/265,717

(22) Filed: Nov. 1, 2005

(65) Prior Publication Data

US 2006/0094599 A1 May 4, 2006

(30) Foreign Application Priority Data

Nov. 2, 2004 (JP) ..... 2004-319797

(51) Int. Cl.
*B41M 5/337* (2006.01)

(52) U.S. Cl. ..... 503/201; 428/64.4; 430/945; 503/209; 503/216; 503/226

(58) Field of Classification Search ..... None
See application file for complete search history.

(56) References Cited

U.S. PATENT DOCUMENTS

| | | | | |
|---|---|---|---|---|
| 5,296,439 | A | 3/1994 | Maruyama et al. | |
| 5,395,433 | A | 3/1995 | Maruyama et al. | |
| 5,432,534 | A | 7/1995 | Maruyama et al. | |
| 5,521,138 | A | 5/1996 | Shimada et al. | |
| 5,817,599 | A | 10/1998 | Iida et al. | |
| 5,942,377 | A | 8/1999 | Torii et al. | |
| 5,981,115 | A | 11/1999 | Furuya et al. | |
| 5,981,429 | A | 11/1999 | Kawamura et al. | |
| 6,090,748 | A | 7/2000 | Furuya et al. | |
| 6,154,243 | A | 11/2000 | Tatewaki et al. | |
| 6,261,992 | B1 | 7/2001 | Furuya et al. | |
| 6,265,344 | B1 * | 7/2001 | Shimbo et al. | 503/205 |
| 6,579,826 | B2 | 6/2003 | Furuya et al. | |
| 6,656,879 | B2 | 12/2003 | Tsutsui et al. | |
| 6,734,138 | B2 | 5/2004 | Suzuki et al. | |
| 6,770,592 | B2 | 8/2004 | Suzuki et al. | |
| 6,818,591 | B2 | 11/2004 | Arai et al. | |
| 2005/0014645 | A1 | 1/2005 | Shimbo et al. | |
| 2005/0176582 | A1 | 8/2005 | Arai et al. | |

FOREIGN PATENT DOCUMENTS

| | | |
|---|---|---|
| EP | 0 492 628 A | 7/1992 |
| JP | 55-154198 | 12/1980 |
| JP | 60-193691 | 2/1985 |
| JP | 61-237684 | 10/1986 |
| JP | 62-138556 | 6/1987 |

(Continued)

*Primary Examiner*—Bruce H Hess
(74) *Attorney, Agent, or Firm*—Cooper & Dunham LLP

(57) ABSTRACT

A reversible thermosensitive recording medium including a substrate, and a thermosensitive layer including an electron donating coloring compound, an electron accepting compound, and a phenol anti-oxidation agent containing one or more sulfur atoms having an alkyl group on one side. In addition, the thermosensitive layer reversibly changes its color tone depending on temperature to reversibly record and erase an image thereon.

21 Claims, 11 Drawing Sheets

FOREIGN PATENT DOCUMENTS

| | | |
|---|---|---|
| JP | 62-138568 | 6/1987 |
| JP | 62-140881 | 6/1987 |
| JP | 02-188293 | 7/1990 |
| JP | 02-188294 | 7/1990 |
| JP | 03-169590 | 7/1991 |
| JP | 04-224996 | 8/1992 |
| JP | 04-247985 | 9/1992 |
| JP | 04-267190 | 9/1992 |
| JP | 05-124360 | 5/1993 |

* cited by examiner

FIG. 4A

PROCESS CONTROLLING TABLE

ORDER SHEET

| | |
|---|---|
| ORDER DATE | 2002/9/14 |
| NAME OF TEAM | SATO |
| PERSON IN CHARGE | TANAKA |

ORDER NO.

| NO. | PART CODE | PART NAME | QUAN-TITY | UNIT | NOTE |
|---|---|---|---|---|---|
| 1 | A-190211 | ABC··· | 10 | CASE | |
| 2 | A-250103 | ABC··· | 50 | BOX | |
| 3 | B-530315 | ABC··· | 100 | PIECE | |
| 4 | B-500803 | ABC··· | 30 | CASE | |
| 5 | C-510116 | ABC··· | 50 | KG | |
| 6 | D-501223 | ABC··· | 200 | CASE | |
| 7 | D-750424 | ABC··· | 150 | PIECE | |
| 8 | | | | | |
| 9 | | | | | |
| 10 | | | | | |
| 11 | | | | | |
| 12 | | | | | |
| 13 | | | | | |
| 14 | | | | | |
| 15 | | | | | |

BARCODE

REWRITABLE DISPLAY PORTION

FIG. 4B

NO RF-ID TAG

REVERSIBLE THERMOSENSITIVE RECORDING MEDIUM, REVERSIBLE THERMOSENSITIVE RECORDING LABEL, REVERSIBLE THERMOSENSITIVE RECORDING DEVICE, IMAGE PROCESSING APPARATUS, AND IMAGE PROCESSING METHOD

BACKGROUND OF THE INVENTION

1. Field of the Invention

The present invention relates to a reversible thermosensitive recording medium, a reversible thermosensitive recording label, a reversible thermosensitive recording device, an image processing apparatus, and an image processing method.

2. Discussion of the Background

Thermosensitive recording media utilizing coloring reaction between an electron donating coloring compound (hereinafter referred to as coloring agent) and an electron accepting compound (hereinafter referred to as coloring developer) are well known. With development of office automation, these media are widely used in outputs for computers, facsimile machines, automatic ticket machines, printers for scientific measuring equipment, printers for medical measuring equipment, and magnetic thermal cards such as prepaid cards and reward cards.

However, these thermosensitive recording media are irreversible so that once-used media are inevitably discarded, which leads to an environmental problem. Therefore, in light of recycling use, various kinds of thermal recording media utilizing the coloring reaction between a coloring agent and a coloring developer have been proposed. For example, published unexamined Japanese Patent Application No. (hereinafter referred to as JOP) S60-193691 describes a thermosensitive medium using the combination of gallic acid and fluoroglucinol as a coloring agent. In this application, the coloring compound obtained through thermal colorization is decolored by using water or vapor. However, this medium has a drawback in improvement on water resistance and record preservation property, resulting in size increase in a decolorization device to decolor the coloring compound. JOP S61-237684 describes a rewritable recording medium in which a compound of phenolphthalene, tymolphthalene, bisphenol, etc. isused as a coloring developer. This application describes that a coloring compound can be formed by heating and gradually cooling down the recording medium, and the coloring compound can be decolored by heating the medium to a temperature higher than the coloring temperature and cooling down the medium. However, in addition to the complexity of the processes of colorization and decolorization, the recording medium of this application has a drawback in that the decolorized state achieved after decolorization of the coloring compound still shows color in some degree and therefore it is not possible to obtain an image having a good contrast.

In addition, JOPs S62-140881, S62-138568, and S62-138556 describe a color memory printing material containing a uniform compatible compound formed of a coloring agent, a coloring developer and a carboxylic acid. In these applications, the material achieves a complete colored state at a low temperature, and a complete decolored state at a high temperature. Further, the material can maintain a colored or decolored state at an intermediate temperature. Therefore, it is possible to record white characters (decolored state) on a colored background (colored state) by using a thermal head.

However, since the recorded image is a negative image, its usability is limited, and further it is necessary to maintain a recorded image in a particular temperature range to preserve the recorded image.

JOPs H2-188294 and H2-188293 describe a reversible thermosensitive recording medium using a salt of gallic acid and a higher fatty acid as a coloring developer by which coloring and subtractive coloring are reversibly performed. These media can thermally color the salt in a particular temperature range and decolor the salt at a higher temperature than the range. However, since the coloring and subtractive coloring are performed in a competitive manner, there is a drawback in that it is difficult to thermally control these coloring and subtractive coloring reactions and resultantly hard to obtain an image with good contrast.

As mentioned above, conventional reversible thermosensitive recording media using the reaction between a coloring agent and a coloring developer involve various kinds of drawbacks and are not satisfactory in light of practical use. In addition, these media are totally insufficient as a reversible multi-color thermosensitive recording medium.

Therefore, the inventors of the present invention describe in JOP H5-124360 a reversible thermocoloring material containing an electron donating coloring compound and an electron accepting compound which achieves a colored state by temporarily heating the material to a temperature not lower than its melting point, and a decolored state by temporarily heating the material to separate and crystallize electron accepting coloring compound. The reversible thermocoloring material utilizing the reaction between the coloring agent and the coloring developer described in this application can resolve the drawbacks mentioned above and thermally achieve a colored state and a decolored state with ease. Further, the colored state and the decolored state are stably maintained at room temperature. However, the reversible thermocoloring material is not stable to light. Therefore, the material has a drawback in that, when the recording surface in a colored state in the medium is irradiated with light, its background may be discolored or the density of a decolored state does not lower to the same level as that of the background, resulting in insufficiency of decolorization.

Consequently, a reversible thermosensitive recording medium which has a good light resistance, and repetitively achieves a stable colored state and decolored state in which decolorization is almost complete even when exposed to light, has not been provided.

SUMMARY

Because of these reasons, the present applicants recognize that a need exists for a reversible thermosensitive medium having a good thermal stability and preservation property to obtain and maintain a stable image having a good contrast.

Accordingly, it is desired to provide a reversible thermosensitive recording medium which has a good light resistance, achieves a stable colored state and decolored state in which decolorization is almost complete even when exposed to light, and stably repeats colorization and decolorization. Further, it is desired to provide a reversible thermosensitive recording label, a reversible thermosensitive recording material, an image processing apparatus and an image processing method using the reversible thermosensitive recording medium.

These and other ends as hereinafter described will become more readily apparent and can be attained, either individually or in combination thereof, by a reversible thermosensitive recording medium including a substrate, and a thermosensitive layer. The thermosensitive layer includes an electron donating coloring compound, an electron accepting compound, and a phenol anti-oxidation agent containing one or more sulfur atoms having an alkyl group on its one side. In addition, the thermosensitive layer reversibly changes its color tone depending on temperature to reversibly record and erase an image.

It is preferred that, in the reversible thermosensitive recording medium mentioned above, the phenol anti-oxidation agent is represented by the following chemical structural formula (1) or (2):

(1)

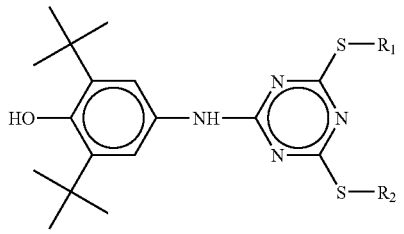

(2)

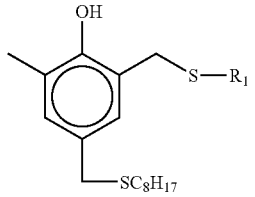

In the formulae (1) and (2), $R_1$ and $R_2$ independently represent an alkyl group.

It is further preferred that, in the reversible thermosensitive recording medium mentioned above, the solid portion of the phenol anti-oxidation agent occupies 1 to 10 weight % based on the weight of the thermosensitive layer.

It is still further preferred that, in the reversible thermosensitive recording medium mentioned above, the electron accepting compound is represented by the following chemical structural formula (3):

(3)

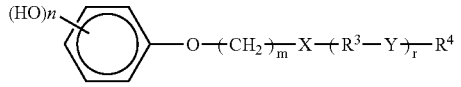

In the formula (3), n represents an integer of from 1 to 3, m represents an integer of from 1 to 20, r represents an integer of from 0 to 3, X and Y each represents a divalent group except for amino group comprising a chain structure comprising hetero atoms, $R^3$ represents divalent chain hydrocarbon group having 1 to 20 carbon atoms, and $R^4$ represents a univalent hydrocarbon group.

It is still further preferred that, in the reversible thermosensitive recording medium mentioned above, a layer containing a polymer having a structure of absorbing ultraviolet rays is provided on the thermosensitive layer.

It is still further preferred that, in the reversible thermosensitive recording medium mentioned above, the polymer in the layer containing a polymer having a structure of absorbing ultraviolet rays is cross-linked.

It is still further preferred that the reversible thermosensitive recording medium mentioned above further contains an ultraviolet ray absorbing agent.

It is still further preferred that, in the reversible thermosensitive recording medium mentioned above, the layer containing a polymer having a structure of absorbing ultraviolet rays contains the ultraviolet ray absorbing agent.

It is still further preferred that, in the reversible thermosensitive recording medium mentioned above, an undercoat layer is provided between the substrate and the thermosensitive layer.

It is still further preferred that, in the reversible thermosensitive recording medium mentioned above, the undercoat layer contains hollow particles.

It is still further preferred that, in the reversible thermosensitive recording medium mentioned above, the reversible thermosensitive recording medium is processed to have a card form, a label form, a sheet form, or a roll form.

It is still further preferred that, in the reversible thermosensitive recording medium mentioned above, at least one side of the side on which an image is formed includes at least one of an irreversible visible information portion and an irreversible printable portion.

In another aspect, a reversible thermosensitive recording label is provided which includes the reversible thermosensitive recording medium mentioned above and an adhesive layer disposed on a side of the reversible thermosensitive recording medium on which an image is not formed.

In another aspect, a reversible thermosensitive recording device is provided which includes an information storage portion and a reversible display portion including the reversible thermosensitive recording medium mentioned above.

It is preferred that, in the reversible thermosensitive recording device mentioned above, the information storage portion and the reversible display portion are integrated.

It is still further preferred that, in the reversible thermosensitive recording device mentioned above, the information storage portion includes one of a magnetically thermosensitive layer, a magnetic stripe, an IC memory, an optical memory, a hologram, an RF-ID tag card, a disc, a disc cartridge, and a cassette tape.

In another aspect, an image processing apparatus is provided which includes at least one of an image forming device configured to form an image on the reversible thermosensitive recording medium mentioned above by heating the reversible thermosensitive medium, and an image erasing device configured to erase the image formed on the reversible thermosensitive medium by heating the reversible thermosensitive medium.

It is preferred that, in the image processing apparatus mentioned above, the image processing device is one of a thermal head and a laser irradiation device.

It is still further preferred that, in the image processing apparatus mentioned above, the image erasing device is one of a thermal head, a ceramic heater, a heat roll, a hot stamp, a heat block, and a laser irradiation device.

In another aspect, an image processing method is provided which includes the steps of forming an image on the reversible thermosensitive recording medium mentioned above by heating the reversible thermosensitive recording medium and/or erasing the image formed on the reversible thermosensitive recording medium by heating the reversible thermosensitive recording medium.

It is preferred that, in the image processing method, image formation is performed by one of a thermal printhead and a laser irradiation device.

It is still further preferred that, in the image processing method mentioned above, image erasure is performed by one of a thermal printhead, a ceramic heater, a heat roll, a hot stamp, a heat block, and a laser irradiation device.

It is still further preferred that, in the image processing method mentioned above, optionally, an image is formed on the reversible thermosensitive recording medium while erasing a previously formed image using a thermal printhead.

These and other features and advantages will become apparent upon consideration of the following description of the preferred embodiments taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 4 is a schematic view illustrating an example (an industrial use rewritable sheet) of the reversible thermosensitive recording medium of the present invention;

DETAILED DESCRIPTION OF THE INVENTION

Figure 1:
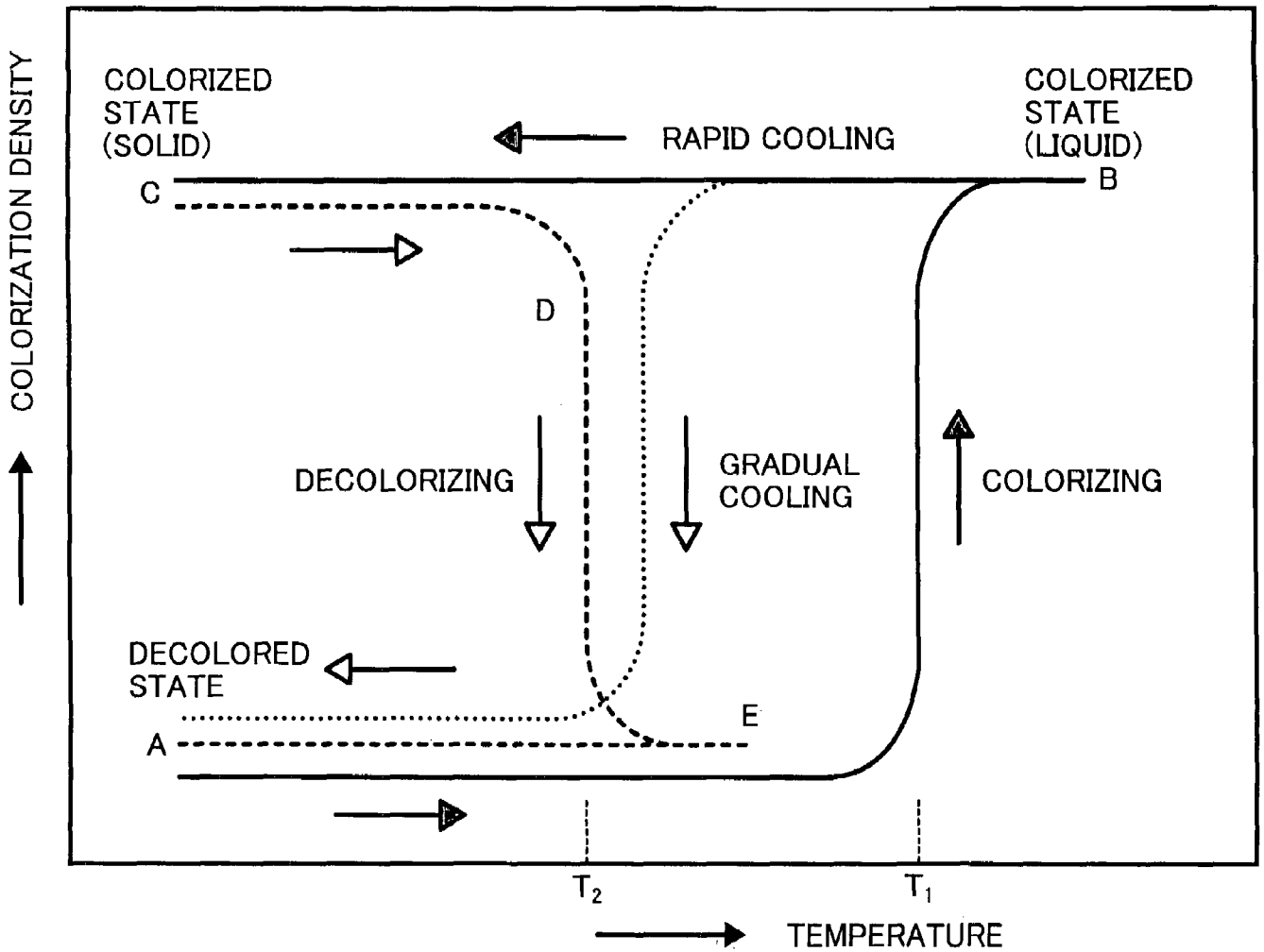
FIG. 1 is a graph illustrating colorization and decolorization characteristics (colorization and decolorization phenomenon) of the reversible thermosensitive recording medium of the present invention.

The present invention will be described below in detail with reference to several embodiments and accompanying drawings.

The reversible thermosensitive recording medium of the present invention includes a substrate, and at least a thermosensitive layer on the substrate. The thermosensitive layer contains an electron donating coloring compound and an electron accepting compound. The color of the layer reversibly changes depending on temperature. The thermosensitive layer contains a phenol-based anti-oxidation agent containing one or more sulfur atoms having an alkyl group on its one side. In the reversible thermosensitive recording medium of the present invention, since the thermosensitive layer has a phenol-based anti-oxidation agent containing one or more sulfur atoms having an alkyl group on its one side, the light resistance of the layer is improved. Therefore, the thermosensitive layer can achieve a stable colored state and decolored state in which decolorization is almost complete even when the layer is exposed to light, and stably repeats colorization and decolorization.

The reversible thermosensitive recording label of the present invention has an adhesive layer on the other side of the reversible thermosensitive recording medium of the present invention from the side on which an image is formed thereon. In the reversible thermosensitive recording label, light resistance is improved and its coloring density is good. It is also possible to perform a high speed decolorization by a thermal head. In addition, decolorization is almost complete even when characters are repetitively printed. Further, the stability of the portion on which characters are printed is excellent. In addition, since the label has an adhesive layer, the label can be widely applied to a portion where the thermosensitive layer is not directly applied. For example, the label can be applied to a thick board such as a card having a magnetic stripe formed of vinyl chloride, a vessel having a sheet size which is larger than a card, a sticker, a large display, etc.

The reversible thermosensitive recording device of the present invention has an information recording portion and a reversible display portion, which is the reversible thermosensitive recording medium of the present invention. Since the thermosensitive layer in the reversible display portion of the reversible thermosensitive recording device contains a phenol anti-oxidation agent containing one or more sulfur atoms having an alkyl group on its one side, the layer has a good light resistance and can perform almost complete decolorization for repetitive use. Further the durability of a printed portion on the layer is extremely improved. Therefore, it is possible to form an image having good visibility. On the other hand, in the information recording portion, desired information such as character information, music information, and image information can be recorded and erased depending on a recording system such as a magnetic thermosensitive layer, a magnetic stripe, an IC memory, an optical memory, an RF-ID tag card, a disc, a disc cartridge, a cassette tape and a hologram.

The image processing apparatus of the present invention includes at least one of an image processing device to form an image and an image erasing device to erase an image by heating the reversible thermosensitive recording medium of the present invention. In the image processing apparatus, the image processing device forms an image on the reversible thermosensitive recording medium by heating the reversible thermosensitive recording medium. On the other hand, the image processing device erases the image formed on the reversible thermosensitive recording medium by heating the reversible thermosensitive recording medium. In the present invention, since the reversible thermosensitive recording medium is the reversible thermosensitive recording medium of the present invention, it is possible to perform highly practical rewritable recording with a good light resistance and good decolorization.

The image processing method of the present invention includes heating the reversible thermosensitive recording medium of the present invention to form and/or erase an image. In the image processing method, images are formed on the reversible thermosensitive recording medium by heating the reversible thermosensitive recording medium of the present invention. In addition, images formed on the reversible thermosensitive recording medium are erased by heating the reversible thermosensitive recording medium of the present invention. In the present invention, since the reversible thermosensitive recording medium is the reversible thermosensitive recording medium of the present invention, images are formed with a high coloring density, a good light resistance and almost complete decolorization and without background fouling, cracking and traces of recording.

Reversible Thermosensitive Recording Medium

The reversible thermosensitive recording medium of the present invention has a substrate and at least a thermosensitive layer on the substrate. Further, the reversible thermosensitive recording medium has a layer containing a polymer having an ultraviolet ray absorption structure, an undercoat layer, an intermediate layer, and other layers if necessary.

Thermosensitive Layer

The thermosensitive layer reversibly changes its color depending on temperature and contains an electron donating coloring compound, an electron accepting compound, a phenol anti-oxidation agent containing one or more sulfur atoms having an alkyl group on its one side, and other components if necessary.

The non-decolorized printed portion in the reversible thermosensitive recording layer formed during decolorization is caused by irradiation of light in the following manner: Oxygen in the atmosphere functions as an oxidant by irradiation of light; Thereby, the electron donating coloring compound in the reversible thermocoloring material deteriorates; and the electron donating coloring compound changes into an irreversible material, resulting in formation of non-decolorized portion during decolorization. Therefore, in the present invention, a phenol anti-oxidation agent containing one or more sulfur atoms having an alkyl group on its one side is added to the reversible thermocoloring material contained in the thermosensitive layer.

Specific examples of such anti-oxidants include phenol-based anti-oxidation agents, amine-based anti-oxidants, sulfur-based anti-oxidants, and phosphate-based anti-oxidants. It is preferred to use phenol-based anti-oxidation agents in terms of effects of restraining the decomposition reaction of an electron donating coloring compound caused by irradiation of light. Among them, a phenol anti-oxidation agent containing one or more sulfur atoms having an alkyl group on its one side is extremely effective as an anti-oxidant and is used in the present invention.

Among the phenol-based anti-oxidation agents containing a sulfur atom, the phenol anti-oxidation agent containing a sulfur atom having an alkyl group on its one side represents the phenol-based anti-oxidation agent in which one of the substitutional groups disposed on the both sides of the sulfur atom is an alkyl group and one is a substitutional group other than an alkyl group. This applies to the case in which two or more sulfur atoms are contained.

There is no specific limit to the alkyl groups mentioned above. It is possible to select any alkyl group depending on purposes. Among these, such an alkyl group preferably has 1 to 12 carbon atoms, and more preferably 1 to 10 carbon atoms and can have any structure of a chain structure, a branch structure and cyclic structure. Specific examples of such alkyl groups include methyl group, ethyl group, propyl group, isopropyl group, butyl group, isobutyl group, tert-butyl group, pentyl group, neopentyl group, hexyl group, cyclohexyl group, octyl group, nonyl group, and decile group. In addition, the alkyl groups can be further substituted by a substitutional group such as a fluorine atom, a cyano group, a phenyl group and a halogen atom.

Preferred specific examples of the phenol-based anti-oxidation mentioned above include the compound represented by the following chemical structure (1) or (2):

[Chemical formula 1]

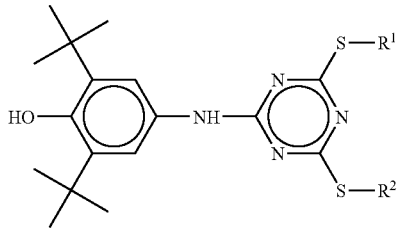

Chemical structure (1)

[Chemical formula 2]

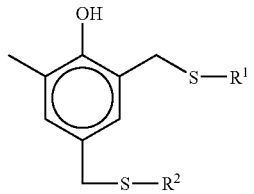

Chemical structure (2)

In the chemical structures (1) and (2), $R^1$ and $R^2$ independently represent an alkyl group. The alkyl groups of $R^1$ and $R^2$ represent the same as the alkyl groups mentioned above. Among these, hexyl group, heptyl group, octyl group and nonyl group are especially preferred.

Therefore, phenol-based anti-oxidation agents containing one or more sulfur atoms having no alkyl group on its one side are not the anti-oxidation agents of the present invention. That is, 4,4-thiobis(3-methyl-6-t-butylphenol) represented by the following chemical structure A, and 2,2-thio-diethylenebis [3-(3,5-di-t-butyl-4-hydroxyphenyl)propionate] represented by the following chemical structure B, are not the phenol-based anti-oxidation agents containing one or more sulfur atoms having an alkyl group on its one side, and therefore, are not included in the anti-oxidation agents of the present invention.

Chemical formula 3

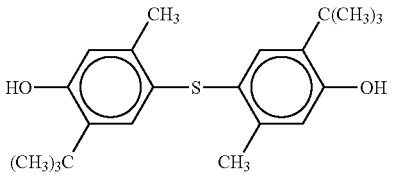

Chemical structure A

Chemical formula 4

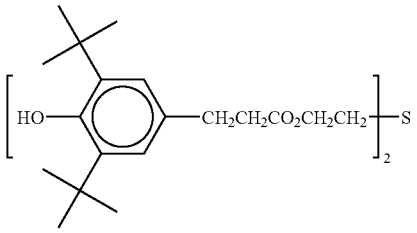

Chemical structure B

Specific examples of such phenol-based anti-oxidation agents containing one or more sulfur atoms having an alkyl group on its one side include 2,4-bis-(n-octylthio)-6-(4-hydroxy-3,5-di-t-butylanilino)-1,3,5-t riadzine represented by the following chemical structure C, and 2,4-bis[ (octylthio) methyl]-o-cresol represented by the following chemical structure D.

Chemical formula 5

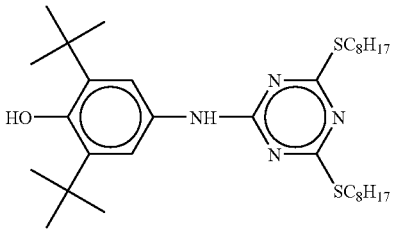

Chemical structure C

Chemical formula 6

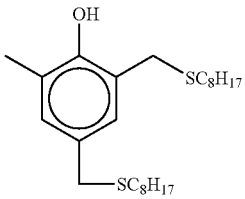

Chemical structure D

Specific examples of such phenol-based anti-oxidation agents containing one or more sulfur atoms having an alkyl group on its one side include suitably synthesized compounds and marketed products such as IRGANOX 1520 and IRGANOX 565, manufactured by Ciba Specialty Chemicals.

There is no specific limit to the content of the phenol-based anti-oxidation agents containing one or more sulfur atoms having an alkyl group on its one side included in the thermosensitive layer. It is possible to select the content depending on purpose. The content thereof is preferably from 1 to 10 weight %, and more preferably from 2 to 8 weight % in solid form. When the content is too small, the anti-oxidation function deteriorates so that it is impossible to restrain the dye decomposition by exposure to light, resulting in colorization of the dye. Thereby, the decolorization function deteriorates. Consequently, non-decolorized portion during decolorization may increase. When the content is too large, background fouling occurs, which may lead to impairing the whiteness of the background before image formation.

The thermosensitive layer contains an electron donating coloring compound and an electron accepting compound and reversibly changes its color depending on temperature.

"Changes its color depending on temperature" in the thermosensitive layer represents a phenomenon of reversible visible color change according to temperature change. In the phenomenon, a relatively colored state and a relatively decolored state can be formed based on the difference of the heating temperature and the cooling speed after heating. The visible change can be classified into the change in color state and the change in form. In the present invention, a material causing a change in color state is mainly used. The change in color state includes changes in transmission ratio, reflectivity, absorption wavelength, diffraction ratio, etc. The reversible thermosensitive recording layer actually displays information using the combination of these changes. Specifically, there is no limit to the material as long as the transparency and/or color thereof can be reversibly changed by heat. Any material can be selected depending on purpose. For example, materials can be used which show a color by heating the material to a first particular temperature higher than room temperature and a different color by heating the material to a second particular temperature higher than the first particular temperature and cooling down the material. Among these, it is particularly preferred to use a material which changes its color state at the first particular temperature and the second particular temperature.

JOP S55-154198 describes a material which achieves a transparent state at the first particular temperature and a white turbidity state at the second particular temperature. JOPs H4-224996, H4-247985 and H4-267190 describe a material which achieves a decolorized state at the first particular temperature and a colorized state at the second particular temperature. JOP H3-169590 describes a material which achieves a white turbidity state at the first particular temperature and a transparent state at the second particular temperature. In addition, JOPs H2-188293 and H2-188294 describe a material which achieves a black, red, or blue color state at the first particular temperature and a decolorized state at the second particular temperature.

The reversible thermosensitive recording medium of the present invention achieves a relatively colorized state and a relatively decolorized state by heating temperature and/or cooling speed after heating.

Fundamental colorization and decolorization phenomena of a material containing a coloring agent and a coloring developer are now described.

FIG. 1 is a graph illustrating the relationship between the coloring density and temperature of the reversible thermosensitive recording medium. When the recording medium in a decolorized state (A) is heated, the medium starts becoming colorized at a temperature T1 at which melting starts, and achieves a melting colorized state (B). When the medium is rapidly cooled down from the melting colorized state (B) to room temperature, the material is cooled down maintaining the colorized state and achieves a solid colorized state (C). Whether this solid colorized state (C) is obtained depends on the descending speed of temperature from the melting colorized state (B). When the descending speed of temperature is slow, decolorization occurs in the middle of cooling down and the decolorized state (A) or a state whose density is relatively thin in comparison with the solid colorized state (C) is achieved. To the contrary, when the temperature of the solid colorized state (C) is raised again, decolorization occurs (from D to E) at a temperature T2 lower than the colorization temperature. When the temperature is lowered from this point, the material is back to the decolorized state (A). Since the colorization temperature and the decolorization temperature vary depending on the combination of the coloring agent and the coloring developer, it is possible to select the combination according to the purpose. In addition, the density in the melting colorized state and the colorization density achieved after rapid cooling are not necessarily the same but can be different.

In the reversible thermosensitive recording medium, the solid colorized state (C) achieved after rapid cooling down from the melting state tends to achieve a solid state and is a mixed state in which the coloring agent and the coloring developer can react by contacting with each other in their molecular level. This state is a state in which colorization is maintained by agglomeration of the coloring developer and the coloring agent. The colorization is stable because of formation of this agglomeration structure. In the decolorized state, the coloring agent and the coloring developer are phase separated. In this state, at least the molecules of one of the coloring agent and the coloring developer agglomerate, form a domain, or are crystallized. The coloring agent and the coloring developer are stably separated by this agglomeration or crystallization. In most cases, decolorization relatively closer to complete decolorization occurs when the coloring agent and the coloring developer are phase separated and the coloring developer is crystallized. In the decolorization state achieved after gradual cooling down from the melting state and the decolorization state achieved after temperature rise from the colorized state as illustrated in FIG. 1, the agglomeration structure changes at this temperature and phase separation and/or crystallization of the coloring developer occur.

Recording by colorization can be performed by heating the reversible thermosensitive recording medium of the present invention to its melting point by a thermal head, etc., and rapidly cooling down the medium. Decolorization state can be achieved by gradually cooling down the material in the heated state or heating the material to a temperature slightly lower than the colorization temperature. These two processes are the same in light of temporarily maintaining the material at a temperature at which the coloring agent and the coloring developer are phase separated or at least one of the coloring agent and the coloring developer is crystallized. The reason why the material is rapidly cooled down to form the colorized state is to avoid maintaining the material at this phase separation temperature or the crystallization temperature. The rapid and gradual cooling down mentioned here are relative and the border therebetween changes depending on the combination of a coloring agent and a coloring developer.

Electron Accepting Compound

There is no specific limit to the selection of the electron accepting compounds (coloring developer) as long as the compound can reversibly perform colorization and decolorization by heat. Any electron accepting compounds can be selected according to purposes. For example, it is preferred to use a compound having at least one of the following structure in its molecule: (1) the structure such as a phenolic hydroxyl group, carboxylic group, and phosphoric group which has a color development function to develop the color of an electron donating compound (coloring agent) and (2) the structure such as a structure in which long-chain hydrocarbon groups are connected which can control the agglomeration power between molecules. In addition, at least one of similar connecting groups and aromatic groups in the long chain hydrocarbon group can be contained. Among these, the phenol compound represented by the following chemical structure (3) is preferred.

[Chemical formula 7]

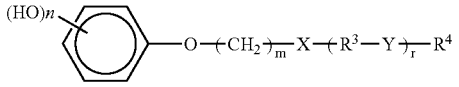

Chemical structure (3)

In the chemical structure (3), n represents an integer of from 1 to 3, m represents an integer of from 1 to 20, r represents an integer of from 0 to 3, X and Y each represents a divalent organic group containing a hetero atom, $R^3$ represents a divalent hydrocarbon group, and $R^4$ represents a univalent hydrocarbon group. $R^3$ and $R^4$ can be further substituted by a substitutional group.

[Chemical formula 8]

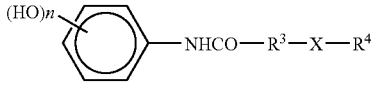

Chemical structure (4)

In the chemical structure (4), n represents an integer of from 1 to 3, X represents a divalent organic group having a hetero atom, $R^3$represents a divalent hydrocarbon group, and $R^4$ represents a univalent hydrocarbon group. $R^3$ and $R^4$ can be further substituted by a substitutional group.

Preferred specific examples of $R^3$ include a hydrocarbon group having 1 to 20 carbon atoms, which can be substituted by other substitutional group.

Preferred examples of $R^3$ include the following:

Chemical formulae 9

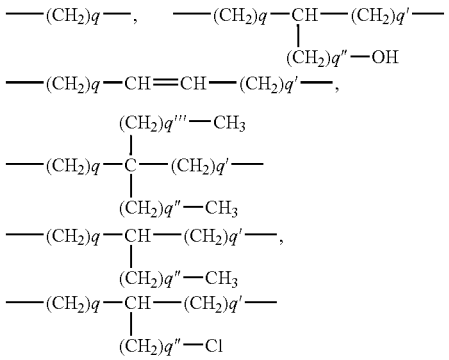

In the chemical formulae, each of q, q', q" and q'" represents an integer satisfying the number of carbons of $R^3$. Among these, —$(CH_2)_q$— is especially preferred.

$R^4$ represents an aliphatic hydrocarbon group having 1 to 24 carbon atoms and preferably from 8 to 18, which can be substituted by a substitutional group.

The aliphatic hydrocarbon group can be straight-chained or branch-chained and can have an unsaturated linkage. The substitutional groups liked with the hydro carbon group can be hydroxyl group, a halogen atom, an alkoxy group, etc. When the total number of the carbons in $R^3$ and $R^4$ is 7 or less, the stability of colorization and decolorization deteriorates. Therefore, the total number thereof is preferably 8 or more, and more preferably 11 or more.

Preferred specific examples of $R^4$ include the following:

Chemical formulae 10

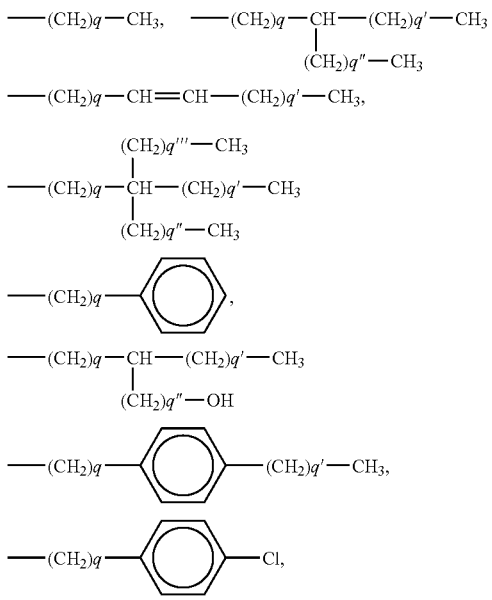

In the chemical formulae, each of q, q', q" and q'" represents an integer satisfying the number of carbons of $R^4$. Among these, —$(CH_2)_q$ and —$CH_3$ is especially preferred.

X and Y each in the chemical structures (3) and (4) represent a divalent organic group. Especially, a divalent group containing a nitrogen atom or an oxygen atom is preferred. For example, a divalent group having at least one group selected from the groups represented by the following chemical formulae.

Chemical formulae 11

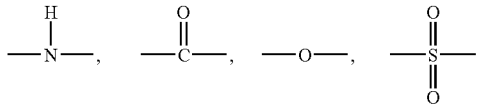

Preferred specific examples of the divalent organic groups include the groups represented by the following chemical formulae.

[Chemical formulae 12]

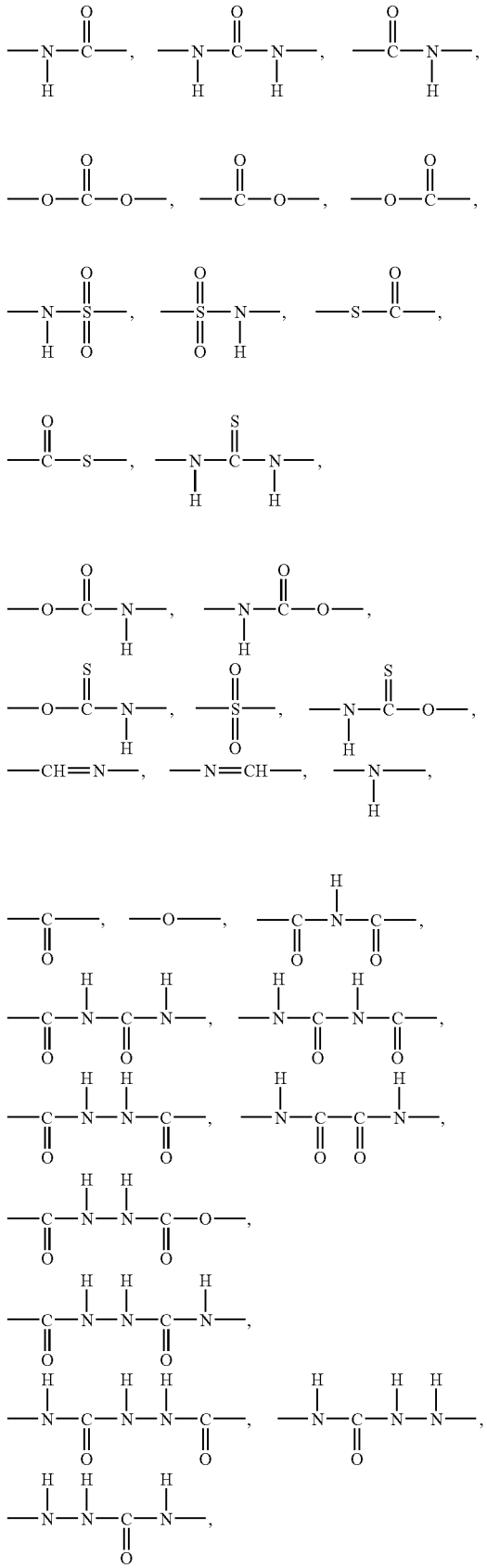

Among these, especially preferred groups are the groups represented by the following chemical formulae.

[Chemical formulae 13]

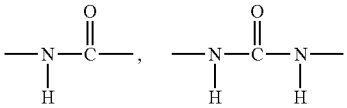

Preferred specific examples of the phenol compounds represented by the chemical structure (3) include the compounds represented by the following chemical structures (3-1) to (3-4).

[Chemical formulae 14]

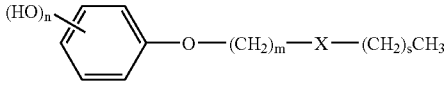

Chemical structure (3-1)

[Chemical formulae 15]

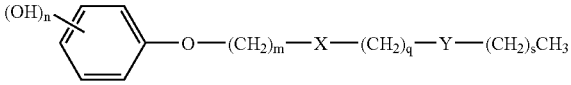

Chemical structure (3-2)

[Chemical formulae 16]

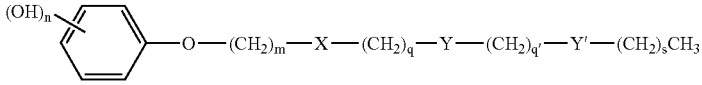

Chemical structure (3-3)

[Chemical formulae 17]

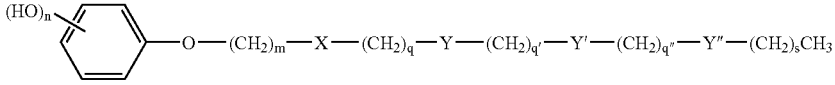

Chemical structure (3-4)

In the chemical structures (3-1) to (3-4), each of q, q', q" and s represents an integer of from 0 to 20 and the sum of these integers is not less than 8. X, Y, Y' and Y" independently represent a divalent organic group having a hetero atom.

Preferred specific examples of the phenol compounds represented by the chemical structures (3-1) and (3-2) include the following. In addition, specific examples of X and Y each in the chemical structures (3-3) and (3-4) are the same as those of the chemical structures (3-1) and (3-2). However, the phenol compounds are not limited thereto.

TABLE A

| n | m | X | q | Y | s |
|---|---|---|---|---|---|
| 1(p-) | 1 | —NHCO— | 0 | — | 16 |
| 1(p-) | 2 | —NHCO— | 0 | — | 16 |
| 1(p-) | 2 | —NHCONH— | 0 | — | 16 |
| 1(p-) | 3 | —NHCONH— | 0 | — | 16 |
| 1(p-) | 1 | —NHCONHSO$_2$— | 0 | — | 16 |
| 1(p-) | 3 | —NHCOO— | 0 | — | 16 |
| 1(p-) | 1 | —NHCSO— | 0 | — | 16 |
| 1(p-) | 1 | —NHCSNH— | 0 | — | 16 |
| 1(p-) | 2 | —CONH— | 0 | — | 16 |
| 1(p-) | 1 | —CONH— | 0 | — | 16 |
| 1(p-) | 3 | —COO— | 0 | — | 16 |
| 1(p-) | 8 | —O— | 0 | — | 16 |
| 1(p-) | 1 | —CONH— | 0 | — | 16 |
| 1(p-) | 2 | —CONHNH— | 0 | — | 16 |
| 1(p-) | 3 | —OCONH— | 0 | — | 16 |
| 1(p-) | 2 | —OCO— | 0 | — | 16 |
| 1(p-) | 1 | —NHCO— | 2 | —NHCO— | 16 |
| 1(p-) | 1 | —NHCO— | 4 | —NHCONH— | 17 |
| 1(p-) | 1 | —NHCO— | 5 | —OCONH— | 17 |

TABLE A-continued

| n | m | X | q | Y | s |
|---|---|---|---|---|---|
| 1(p-) | 2 | —NHCO— | 4 | —CONH— | 17 |
| 1(p-) | 2 | —NHCO— | 4 | —O— | 17 |
| 1(p-) | 2 | —NHCO— | 4 | —SO$_2$— | 17 |
| 1(p-) | 6 | —CONH— | 5 | —CONHCO— | 12 |
| 1(p-) | 1 | —CONH— | 4 | —NHCONH— | 17 |
| 1(p-) | 2 | —CONH— | 2 | —NHCO— | 16 |
| 1(p-) | 4 | —CONH— | 6 | —NHCOO— | 11 |
| 1(p-) | 1 | —CONH— | 6 | —SO$_4$— | 11 |
| 1(p-) | 1 | —CONH— | 6 | —S— | 11 |
| 1(p-) | 1 | —COO— | 2 | —NHCO— | 16 |
| 1(p-) | 1 | —COO— | 3 | —CONH— | 16 |

TABLE A-continued

| n | m | X | q | Y | s |
|---|---|---|---|---|---|
| 1(p-) | 3 | —CONHCO— | 10 | —COO— | 12 |
| 1(p-) | 2 | —CONHCO— | 6 | —NHCONH— | 17 |
| 1(p-) | 5 | —NHCOO— | 10 | —NHCO— | 12 |

Preferred specific examples of the phenol compounds represented by the chemical structure (4) include the compounds represented by the following chemical structures (4-1) or (4-2).

[Chemical formulae 18]

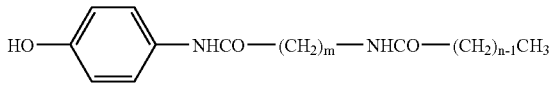

Chemical structure (4-1)

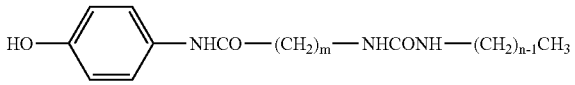

Chemical structure (4-2)

In the chemical structures (4-1) and (4-2), m represents an integer of from 5 to 11, and n represents an integer of from 8 to 22.

Specific examples of the phenol compounds represented by the chemical structures (4-1) and (4-2) include the following.

[Chemical formulae 19]

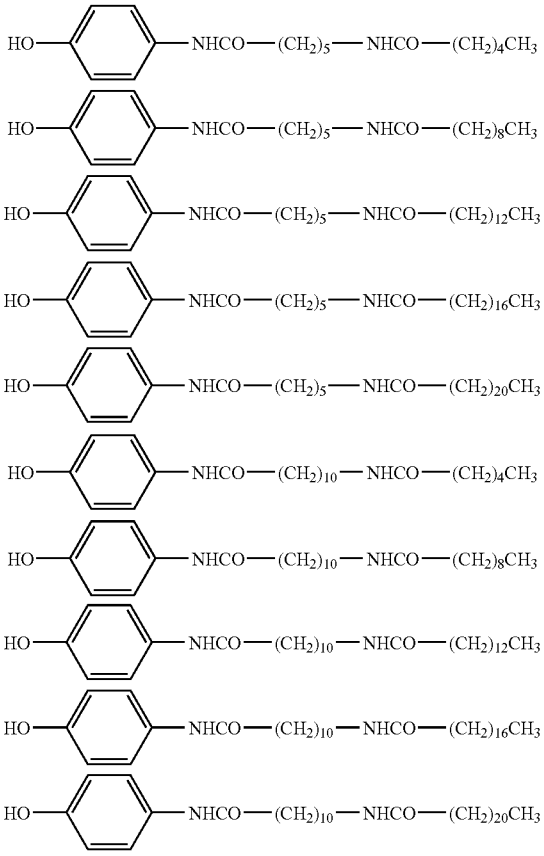

[Chemical formulae 20]

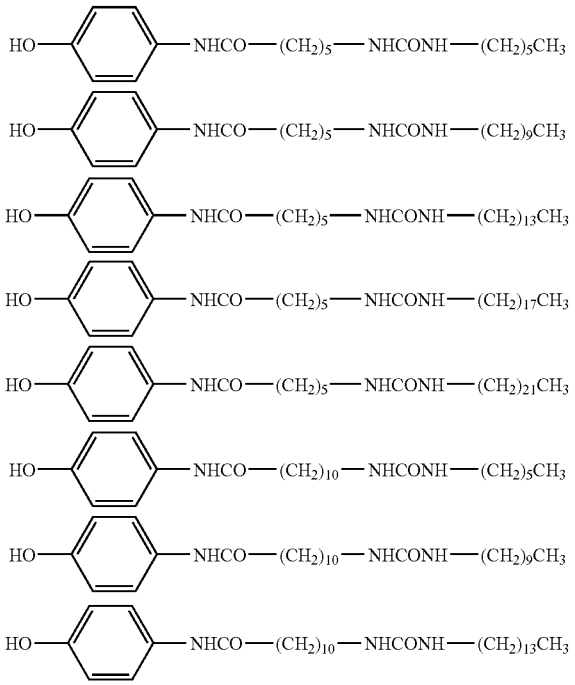

-continued

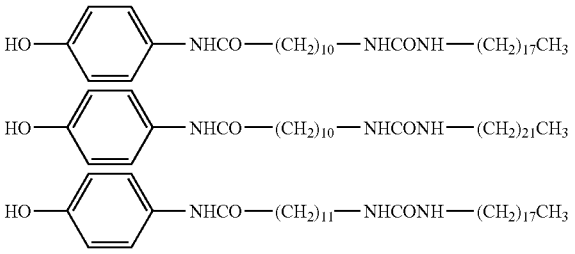

Electron Donating Coloring Compounds

There is no specific limit to the electron donating coloring compounds (coloring agent) mentioned above. Any compound can be selected according to purposes. For example, leuco dyes can be preferably used.

Suitably preferred specific examples of the leuco dyes mentioned above include fluoran compounds and azaphthalide compounds such as:

2-anilino-3-methyl-6-diethyl aminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-methyl amino)fluoran,
2-anilino-3-methyl-6-(N-isobutyl-methyl amino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino-)fluoran,
2-anilino-3-methyl-6-(N-methyl-p-toluidino-)fluoran,
2-(m-trichloromethylanilino)-3-methyl-6-diethylanimofluoran,
2-(m-trifluoromethylanilino)-3-methyl-6-diethylanimofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-etylanilino)fluoran,
2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethyl aniline)-6-diethylaminofluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluran,
2-anilino-3-chloro-6-diethylaminofluran,
2-(o-chloroanilino)-3-chloro-6-diethylaminofluran,
2-(m-trifluoromethylanilino)-3-chloro-6-diethylaminofluran,
2-(2,3-dichloroanilino)-3-chloro-6-diethylaminofluran,
1,2-benzo-6-diethylaminofluran,
3-diethylamino-6-(m-trifluoromethylanilino)fluoran, 3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphtalide, and
3,3-bis(2-ethoxy-4-diethylaminophenyl)-7-azaphtalide.

Specific examples of the coloring agents for use in the present invention other than the fluoran compounds and the azaphthalide compounds mentioned above include the following known leuco dyes. These can be used alone or in combination:

2-(p-acetylanilino)-6-(N-n-amyl-N-n-butylamino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-dibutylaminofluoran,
1,2-benzo-6-(N-methyl-N-cyclohexylamino)fluoran,
1,2-benzo-6-(N-ethyl-N-toluidino)fluoran, and others.

Layers showing different colors can be accumulated to show multi-color or full-color.

Although it is impossible to generally regulate a suitable range of the mixture ratio of the electron donating coloring compounds (coloring agent) mentioned above and the electron accepting compounds (coloring developer) because the ratio varies depending on the combination of these compounds, the mixing ratio of the coloring developer to the coloring agent is preferably 0.1 to 20, and more preferably 0.2 to 10. When the mixing ratio is too small or too large, the density of colorized state may deteriorate, resulting in a problem. In addition, it is possible to encapsulate the coloring developer and the coloring agent in a microcapsule.

Decolorization Helping Agent

In the present invention, it is possible to extremely accelerate the decolorization speed by the combinational use of the coloring developer and a decolorization helping agent having at least one of amide group, urethane group and urea group in its molecule. This occurs because inter-molecular function is induced between a coloring developer and a decolorization helping agent in the process of forming a decolorization state.

Any compound having at least one of amide group, urethane group and urea group in its molecule can be used as a decolorization helping agent. Particularly preferred specific examples of such an agent include the compounds represented by the following structural formulae (5) to (11).

[Chemical formula 21]

$R^5—NHCO—R^6$

Chemical structure (5)

$R^5—NHCO—R^7—CONH—R^6$

Chemical structure (6)

$R^5—CONH—R^7—CONH—R^6$

Chemical structure (7)

$R^5—NHCOO—R^6$

Chemical structure (8)

$R^4—NHCOO—R^6$

Chemical structure (9)

$R^4—OCONH—R^7—NHCOO—R^6$

Chemical structure (10)

$$R^4—NHCOO—\underset{\underset{OCONH—R^7}{|}}{R^8}—OCONH—R^5$$

Chemical structure (11)

In the chemical structures (5) to (11), $R^5$, $R^6$ and $R^8$ represent a straight chained alkyl group, a branch chained alkyl group, and an unsaturated alkyl group having 7 to 22 carbon atoms, $R^7$ represents a divalent functional group having 1 to 10 carbon atoms, $R^9$ represents a trivalent functional group having 4 to 10 carbons.

Specific examples of $R^5$, $R^6$, and $R^8$ include heptyl group, octyl group, nonyl group, decyl group, undecyl group, dodecyl group, stearyl group, behenyl group, and oleyl group.

Specific examples of $R^7$ include methylene group, ethylene group, propylene group, butylene group, hepta methylene group, hexamethylene group, octamethylene group, $—C_3H_6OC_3H—$ group, $—C_2H_4OC_2H_4—$ group, and $—C_2H_4OC_2H_4OC_2H_4—$ group.

Preferred specific examples of $R^7$ include the following:

[Chemical formulae 22]

$$C_2H_5—\begin{array}{c}CH_2—\\|\\CCH_2—\\|\\CH_2—\end{array},\quad \begin{array}{c}CH_2—\\|\\CH—\\|\\CH_2—\end{array},\quad \begin{array}{c}CH_2CH_2—\\|\\CH—\\|\\CH_2CH_2—\end{array},$$

-continued

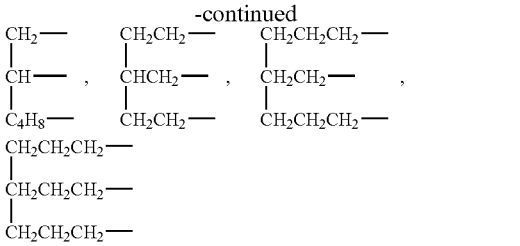

Specific examples of the compounds represented by the chemical structural formulae (8) to (14) include the compounds represented by (1) to (81).

(1) $C_{11}H_{23}CONHC_{12}H_{25}$,
(2) $C_{15}H_{31}CONHC_{16}H_{33}$,
(3) $C_{17}H_{35}CONHC_{18}H_{37}$,
(4) $C_{17}H_{35}CONHC_{18}H_{35}$,
(5) $C_{21}H_{41}CONHC_{18}H_{37}$,
(6) $C_{15}H_{31}CONHC_{18}H_{37}$,
(7) $C_{17}H_{35}CONHCH_2NHCOC_{17}H_{35}$,
(8) $C_{11}H_{23}CONHCH_2NHCOC_{11}H_{23}$,
(9) $C_7H_{15}CONHC_2H_4NHCOC_{17}H_{35}$,
(10) $C_9H_{19}CONHC_2H_4NHCOC_9H_{19}$,
(11) $C_{11}H_{23}CONHC_2H_4NHCOC_{11}H_{23}$,
(12) $C_{17}H_{35}CONHC_2H_4NHCOC_{17}H_{35}$,
(13) $(CH_3)_2CHC_{14}H_{35}CONHC_2H_4NHCOC_{14}H_{35}(CH_3)_2$,
(14) $C_{21}H_{43}CONHC_2H_4NHCOC_{21}H_{43}$,
(15) $C_{17}H_{35}CONHC_6H_{12}NHCOC_{17}H_{35}$,
(16) $C_{21}H_{43}CONHC_6H_{12}NHCOC_{21}H_{43}$,
(17) $C_{17}H_{33}CONHCH_2NHCOC_{17}H_{33}$,
(18) $C_{17}H_{33}CONHC_2H_4NHCOC_{17}H_{33}$,
(19) $C_{21}H_{41}CONHC_2H_4NHCOC_{21}H_{41}$,
(20) $C_{17}H_{33}CONHC_6H_{12}NHCOC_{17}H_{33}$,
(21) $C_8H_{17}NHCOC_2H_4CONHC_{18}H_{37}$,
(22) $C_{10}H_{21}NHCOC_2H_4CONHC_{10}H_{21}$,
(23) $C_{12}H_{25}NHCOC_2H_4CONHC_{12}H_{25}$,
(24) $C_{18}H_{37}NHCOC_2H_4CONHC_{18}H_{37}$,
(25) $C_{21}H_{43}NHCOC_2H_4CONHC_{21}H_{43}$,
(26) $C_{18}H_{37}NHCOC_6H_{12}CONHC_{18}H_{37}$,
(27) $C_{18}H_{35}NHCOC_4H_8CONHC_{18}H_{35}$,
(28) $C_{18}H_{35}NHCOC_8H_{16}CONHC_{18}H_{35}$,
(29) $C_{12}H_{25}OCONHC_{18}H_{37}$,
(30) $C_{13}H_{27}OCONHC_{18}H_{37}$,
(31) $C_{16}H_{33}OCONHC_{18}H_{37}$,
(32) $C_{18}H_{37}OCONHC_{18}H_{37}$,
(33) $C_21H_{43}OCONHC_{18}H_{37}$,
(34) $C_{12}H_{25}OCONHC_{16}H_{33}$,
(35) $C_{13}H_{27}OCONHC_{16}H_{33}$,
(36) $C_{16}H_{33}OCONHC_{16}H_{33}$,
(37) $C_{18}H_{37}OCONHC_{16}H_{33}$,
(38) $C_{21}H_{43}OCONHC_{16}H_{33}$,
(39) $C_{12}H_{25}OCONHC_{14}H_{29}$,
(40) $C_{13}H_{27}OCONHC_{14}H_{29}$,
(41) $C_{16}H_{33}OCONHC_{14}H_{29}$,
(42) $C_{18}H_{37}OCONHC_{14}H_{29}$,
(43) $C_{22}H_{45}OCONHC_{14}H_{29}$,
(44) $C_{12}H_{25}OCONHC_{12}H_{37}$,
(45) $C_{13}H_{27}OCONHC_{12}H_{37}$,
(46) $C_{16}H_{33}OCONHC_{12}H_{37}$,
(47) $C_{18}H_{37}OCONHC_{12}H_{37}$,
(48) $C_{21}H_{43}OCONHC_{12}H_{37}$,
(49) $C_{22}H_{45}OCONHC_{18}H_{37}$,
(50) $C_{18}H_{37}NHCOOC_2H_4OCONHC_{18}H_{37}$,
(51) $C_{18}H_{37}NHCOOC_3H_6OCONHC_{18}H_{37}$,
(52) $C_{18}H_{37}NHCOOC_4H_8OCONHC_{18}H_{37}$,
(53) $C_{18}H_{37}NHCOOC_6H_{12}OCONHC_{18}H_{37}$,
(54) $C_{18}H_{37}NHCOOC_8H_{16}OCONHC_{18}H_{37}$,
(55) $C_{18}H_{37}NHCOOC_2H_4OC_2H_4OCONHC_{18}H_{37}$,
(56) $C_{18}H_{37}NHCOOC_3H_6OC_3H_6OCONHC_{18}H_{37}$,
(57) $C_{18}H_{37}NHCOOC_{12}H_{24}OCONHC_{18}H_{37}$,
(58) $C_{18}H_{37}NHCOOC_2H_4OC_2H_4OC_2H_4OCONHC_{18}H_{37}$,
(59) $C_{16}H_{33}NHCOOC_2H_4OCONHC_{16}H_{33}$,
(60) $C_{16}H_{33}NHCOOC_3H_6OCONHC_{16}H_{33}$,
(61) $C_{16}H_{33}NHCOOC_4H_8OCONHC_{16}H_{33}$,
(62) $C_{16}H_{33}NHCOOC_6H_{12}OCONHC_{16}H_{33}$,
(63) $C_{15}H_{33}NHCOOC_8H_{16}OCONHC_{16}H_{33}$,
(64) $C_{18}H_{37}OCOHNC_6H_{12}NHCOOC_{18}H_{37}$,
(65) $C_{16}H_{33}OCOHNC_6H_{12}NHCOOC_{16}H_{33}$,
(66) $C_{14}H_{29}OCOHNC_6H_{12}NHCOOC_{14}H_{29}$,
(67) $C_{12}H_{25}OCOHNC_6H_{12}NHCOOC_{12}H_{25}$,
(68) $C_{10}H_{21}OCOHNC_6H_{12}NHCOOC_{10}H_{21}$,
(69) $C_8H_{17}OCOHNC_6H_{12}NHCOOC_8H_{17}$.

[Chemical formulae 23]

(70)

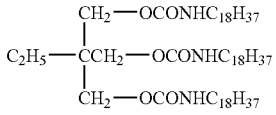

(71)

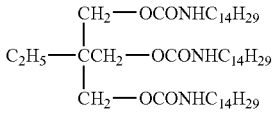

(72)

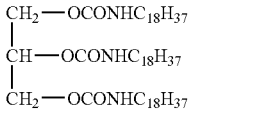

(73)

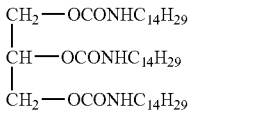

(74)

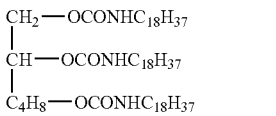

(75)

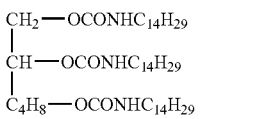

(76)

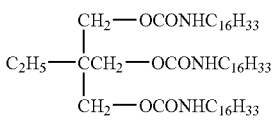

(77)

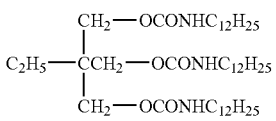

(78)

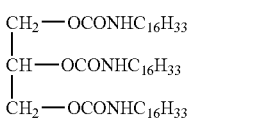

-continued (79)

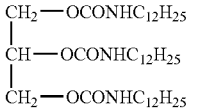

(80)

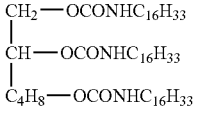

(81)

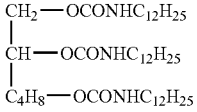

The addition amount of the decolorization helping agent is preferably from 0.1 to 300 parts by weight based on 100 parts by weight of the coloring developer, and more preferably from 3 to 100 parts by weight. When the addition amount is too small, the added decolorization helping agent may not fully exercise its effect. When the addition amount is too large, the density of the colorization may decrease.

A binder resin and various kinds of additives if necessary by which coating characteristics and colorization and decolorization characteristics of a thermosensitive layer can be improved and controlled can be used in the thermosensitive layer. Specific examples of such additives include cross-linking agents, cross-linking helping agents, fillers, lubricants, surfactants, electroconductive agents, anti-oxidation agents, light-stabilizers, and plasticizers.

There is no specific limit to the binder resin mentioned above. The binder resin can be selected depending on purposes. Specific examples of such binder resins for use in forming a reversible thermosensitive recording layer of the reversible thermosensitive recording medium of the present invention include polyvinyl chloride resins, polyvinyl acetate resins, copolymers of a vinyl chloride and a vinyl acetate, ethyl celluloses, polystyrene resins, styrene containing copolymers, phenoxy resins, polyester resins, aromatic polyester resins, polyurethane resins, polycarbonate resins, polyacrylic ester resins, polymethacrylic ester resins, acrylic acid based copolymers, maleic acid based copolymers, polyvinyl alcohol resins, modified polyvinyl alcohol resins, hydroxylethyl celluloses, carboxymethyl celluloses and amylums.

The function of these binders is to maintain the uniform dispersion state of each material upon application of heat for erasing records. Therefore, it is preferred to use a binder resin having a good heat resistance property.

It is preferred to add a cross-linking agent to the binder resin mentioned above to obtain a curing resin which can be cross-linked by heat, ultraviolet ray, electron beam, etc. By having such a curing resin in the thermosensitive layer mentioned above, heat resistance and coating layer strength of the thermosensitive layer are improved, resulting in improvement of the repetitive recording durability of a reversible thermosensitive recording medium.

There is no specific limit to the curing resins mentioned above. The curing resins can be selected depending on purposes. Specific examples of such curing resins include resins having a group reactive with a cross-linking agent such as acrylic polyol resins, polyester polyol resins, polyurethane polyol resins, phenoxy resins, polyvinyl butyral resins, cellulose acetate propionates and cellulose acetate butyrates, and copolymer resins formed of a monomer having a group reactive with a cross-linking agent and another monomer but are not limited thereto.

In addition, the hydroxyl group value of the curing resin is preferably not less than 70 [KOH] mg/g and more preferably 90 [KOH] mg/g. Thereby, the durability, the surface strength of a coating layer, and cracking resistance can be improved. The value of the hydroxyl group value affects the density of cross linking and resultantly anti-chemical property and physical property of the coated layer.

The acryl polyol resins can be prepared from (meth) acrylic acid ester monomer, an unsaturated monomer having a carboxyl group, an unsaturated monomer having a hydroxyl group, and an unsaturated ethylenic monomer by a known solution polymerization method, suspension polymerization method, emulsification polymerization method, etc. Specific examples of such unsaturated monomers having a hydroxyl group include hydroxyethylacrylate (HEA), hydroxypropyl acrylate (HPA), 2-hydroxyethyl methacrylate (HEMA), 2-hydroxypropylacrylate (HPMA), 2-hydroxybutyl monoacrylate (2-HBA), and 1,4-hydroxybutyl monoacrylate (1HBA). Cracking resistance and durability of a coated layer are relatively good especially when a monomer having a primary hydroxyl group is used. Therefore, among these, 2-hydroxyethyl methacrylate (HEMA) is more preferred.

Specific examples of the cross-linking agents mentioned above include known isocyanates, amines, phenol, epoxy compounds, etc. Among these, isocyanate curing resins are preferably used. Specific examples of such isocyanate containing curing resins include modified compounds of known isocyanate monomers such as urethane modified compounds, allophanate modified compounds, isocyanulate modified compounds, biuret modified compounds, carbodiimide modified compounds and blocked isocyanate modified compounds. Specific examples of isocyanate monomers forming such modified compounds include tolylene diisocyanate (TDI), 4,4'-diphenyl methane diisocyanate (MDI), xylylene diisocyanate (XDI), naphthylene diisocyanate (NDI), paraphenylenen diisocyanate (PPDI), tetramethyl xylylene diisocyanate (TMXDI), hexamethylene diisocyanate (HDI), dicyclo hexyl methane diisocyanate (HMDI), isophorone diisocyanate (IPDI), lysine diisocyanate (LDI), isopropylidenebis (4-cyclohexyl isocyanate) (IPC), cyclo hexyl diisocyanate (CHDI) and tolidine diisocyanate (TODI) but are not limited thereto.

In addition, catalysts for use in this type of reaction can be used as the cross-linking promoter mentioned above. Specific examples of such cross-linking promoters include tertiary amines such as 1,4-diaza-bicyclo (2,2,2) octane, and metal compounds such as organic tin compounds. The entire amount of a cross-linking agent for use in cross-linking reaction is not necessarily consumed. There is no problem when some of the curing agent remains non-reacted. This type of cross-linking reaction proceeds over time. Therefore, just because there is some curing agent remaining non-reacted does not mean no cross-linking reaction has occurred. Namely, even when non-reacted curing agent is detected, it does not necessarily mean that there is no cross-linked resin. Whether or not a polymer is cross-linked can be determined by dipping a coated film in a solvent which the polymer is highly soluble. When the non cross-linked polymer in the coated film is dipped in the solvent, the non cross-linked polymer dissolves into the solvent. Thereafter, whether the polymer structure remains in the coated film is analyzed. When the polymer structure is not confirmed in the coated film, the polymer is determined to be in a non cross-linked state. This can be represented by gel ratio.

The gel ratio mentioned above is a gel production ratio when resin solutes in a solvent lose their independent movement property due to interaction among the resin solutes and aggregate to form a gel. The resin preferably has a gel ratio not less than 30%, more preferably not less than 50%, further preferably not less than 70% and particularly preferably not less than 80%. When the gel ratio of a resin is too small, repetitive durability thereof deteriorates. To increase the gel ratio, it is good to mix a curing resin which is hardened by heat, ultraviolet rays (UV), electron beams (EB), etc., with the resin, or to cross-link the resin itself.

The gel ratio mentioned above can be measured by:

(1) removing the film from a substrate and measuring the initial weight of the film;
(2) pinching the film with metallic meshes having 400 meshes;
(3) dipping the film in a solvent which can dissolve the resin before cross-linking for 24 hours; and
(4) measuring the weight of the film after vacuum drying the film.

The gel ratio is calculated by the following relationship (1).

$$\text{Gel ratio (\%)}=[\text{weight after drying (g)}/\text{the initial weight (g)}]\times 100 \quad (1)$$

When the gel ratio is calculated using this relationship, the weight of the substances other than the resin composition in the thermosensitive layer, such as organic low molecular weight materials, is eliminated. When the weight of such other substances is uncertain, the weight can be determined by calculating the weight ratio of such other substances. The weight ratio can be determined by using the area ratio per unit area determined by observing the cross section by transmission electron microscope (TEM), scanning electron microscope (SEM), etc., and specific gravities of the resin and the organic low molecular weight materials to calculate the weight thereof. The gel ratio can be thus obtained.

When a medium includes a substrate, a reversible thermosensitive recording layer located overlying the substrate and another layer such as a protective layer disposed on the reversible thermosensitive recording layer or between the substrate and the reversible thermosensitive recording layer, the thicknesses of the reversible thermosensitive recording layer and the other layer are determined by observing the cross section thereof by transmission electron microscope (TEM), scanning electron microscope (SEM), etc. before performing the gel ratio measurement mentioned above. Then, the other layer is shaved from the medium for the thickness determined by observation to expose the surface of the reversible thermosensitive recording layer. The reversible thermosensitive recording layer is removed to perform the measurement mentioned above to obtain the gel ratio thereof.

Further, when there is a protective layer formed of an ultraviolet curing resin, etc., on a reversible thermosensitive recording layer, contamination of the protective layer is necessary to be prevented as much as possible to minimize the affect to the gel ratio in this method. Therefore, it is preferred to slightly shave the surface of the reversible thermosensitive recording layer together with the protective layer.

The fillers mentioned above are typified into inorganic fillers and organic fillers. Specific examples of such inorganic fillers include calcium carbonate, magnesium carbonate, silicic acid anhydride, alumina, iron oxides, calcium oxides, magnesium oxides, chromium oxides, manganese oxides, silica, talc and mica.

Specific examples of such organic fillers include: silicone resins; cellulose resins; epoxy resins; nylon resins; phenol resins; polyurethane resins; urea resins; melamine resins; polyester resins; polycarbonate resins; resins containing styrenes such as styrenes, polystyrenes, polystyrene/isoprenes and styrene/vinylbenzenes; acrylic resins such as vinylidene acrylic chloride, acrylic urethane and ethylene acryl; polyethylene resins; resins containing formaldehyde such as benzoguanamine formaldehyde and melamine formaldehyde; polymethyl methacrylate resins; and vinyl chloride resins.

These fillers can be used alone or in combination. There is no specific limit to the combination of the inorganic fillers and the organic fillers. These fillers can have a sphere form, a particle form, a board form, a needle form, etc. The content of the filler in a protective layer is from 5 to 50% by volume.

There is no specific limit to the lubricant mentioned above. It is possible to select known lubricants according to purposes. Specific examples of such lubricants include: synthetic waxes such as ester waxes, paraffin waxes and polyethylene waxes; vegetable waxes such as hardened ricinus oil; animal oils such as hardened beef tallow oil; higher alcohols such as stearyl alcohol, behenyl alcohol; higher fatty acids such as margaric acid, lauric acid, myristic acid, palmitic acid, stearic acid and behenic acid; higher fatty acid esters such as fatty acid esters of sorbitan; amides such as stearic acid amides, oleic acid amides, lauric acid amids, ethylene bis stearic acid amides, methylene bis stearic acid amides, methylol stearic acid amides. The content of the lubricant in these layers is preferably 0.1 to 95% based on volume, and more preferably 1 to 75% based on volume.

There is no specific limit to the surfactants mentioned above. Any surfactant can be used according to purposes. Specific examples of such surfactants include anion surfactants, cation surfactants, non-ion surfactants, and ampholytic surfactants.

There is no specific limit to the plasticizer mentioned above. Any plasticizer can be used according to purposes. Specific examples of such plasticizers include phosphoric acid esters, aliphatic acid esters, phthalic acid esters, dibasic acid esters, glycols, polyester based plasticizers, and epoxy based plasticizers.

There is no specific limit to methods of forming the thermosensitive layer mentioned above. Any method can be selected according to purposes. Specific examples of such methods include (1) a method including the steps of: applying a thermosensitive layer application liquid to a substrate in which the binder resin mentioned above, the electron donating coloring compound mentioned above and the electron accepting compound mentioned above are dissolved or dispersed in a solvent; and cross-linking is performed while or after evaporating the solvent to obtain a sheet form, (2) a method including the steps of: applying a thermosensitive layer application liquid to a substrate in which the electron donating coloring compound mentioned above and the electron accepting compound mentioned above are dispersed in a solvent in which only the binder resin mentioned above is dissolved; and cross-linking is performed while or after evaporating the solvent to obtain a sheet form, and (3) a method including the steps of: mixing the binder resin mentioned above, the electron donating coloring compound mentioned above and the electron accepting compound mentioned above by melting with heat without using a solvent; forming the melted mixture to obtain a sheet form; and subsequent to cooling down, cross linking is performed.

In these methods, instead of using the substrate mentioned above, it is possible to form a reversible thermosensitive recording medium having a sheet form.

Although the solvent for use in the methods (1) and (2) is impossible to generally specify because the solvent depends on the kinds of the binder resin mentioned above, the electron donating coloring compound mentioned above and the electron accepting compound mentioned above, specific examples of such solvents include tetrahydrofuran, methylethyl ketone, methylisobutyl ketone, chloroform, carbon tetrachloride, ethanol, toluene, and benzene.

In addition, the electron accepting compound is present in the form of a particle in the thermosensitive layer in a dispersed manner.

Also, various kinds of dyes, antifoaming agents, dispersants, slipping agents, antiseptic agents, cross linking agents, and plasticizers can be added to the thermosensitive layer application liquid to have a high grade performance as a coating material.

There is no specific limit to a method of coating the thermosensitive layer mentioned above. Any method can be selected depending on purposes. For example, while transferring a substrate having a sequential roll form or a substrate cut into a sheet form, the following known methods can be used for coating an application liquid on the substrate: blade coating, wire bar coating, spray coating, air knife coating, bead coating, curtain coating, gravure coating, kiss coating, reverse roll coating, dip coating and dye coating.

There is no specific limit to the conditions for drying the thermosensitive application liquid. Any conditions can be selected according to purposes. For example, it is suitable to dry an application liquid at room temperature to 140° C. for about 10 minutes to about 1 hour.

The resin in a thermosensitive layer can be cured by heating, ultraviolet ray irradiation, irradiation of electron beam, etc.

There is no specific limit to the ultraviolet ray irradiation. Any known ultraviolet ray irradiation device can be used. Specific examples of such known ultraviolet ray irradiation devices include a device having a light source, a lamp fitting, a power source, a cooling device, a transfer device, etc.

Specific examples of the light source include a mercury lamp, a metal halide lamp, a gallium lamp, a mercury Xenon lamp, a flash lamp, etc. The wavelength of these light sources can be suitably selected according to the ultraviolet ray absorption wavelength of a light polymerization initiator and a light polymerization accelerator added to the thermosensitive recording material mentioned above.

There is no specific condition for ultraviolet ray irradiation. Such conditions can be selected depending on purposes. For example, the power for lamp, transfer speed, etc. can be determined according to the irradiation energy required to cross-link a resin.

The electron beam irradiation mentioned above can be performed with a known electron beam irradiation device and typified into two kinds, i.e., a scanning type (scanning beam) and non-scanning type (area beam). These types are selected depending on the irradiation area, the irradiation amount, etc. In addition, the conditions for electron beam are determined based on the following mathematic formula 2 according to the irradiation amount required to cross link a resin considering the electron stream, the irradiation width and the transfer speed.

$$D=(\Delta E/\Delta R)\cdot\eta\cdot I/(W\cdot V)$$ <Mathematical Formula 2>

In the mathematical formula 2, D represents the required amount of irradiation (Mrad), ΔE/ΔR represents the average energy loss, η represents the efficiency, I represents the electron current (mA), W represents the irradiation width (cm), and V represents the transfer speed (cm/s).

$$D\cdot V=K\cdot I/W$$ <Mathematical Formula 3>

The device rating is represented by Mrad·m/min and the electron current rating is selected from the range of from 20 to 500 mA.

There is no specific limit to the layer thickness of the thermosensitive layer. The layer thickness can be determined based on purposes and, for example, is preferably from 1 to 20 μm, and more preferably from 3 to 15 μm.

When the layer thickness of the thermosensitive layer is too thin, the density of colorized state tends to be thin, resulting in deterioration of image contrast. To the contrary, when the layer thickness of the thermosensitive layer is too thick, heat distribution in the layer tends to be large. Therefore, the layer does not reach the colorization temperature and resultantly has a non-colorized portion during colorization process so that the desired colorization density cannot be obtained.

<Layer Containing a Polymer Having an Ultraviolet Ray Absorption Structure>

It is already known that, in a reversible thermosensitive recording medium, an addition of an ultraviolet ray agent is effective to decrease background discolorization caused by irradiation of light because background discolorization can be decreased by cutting light in the ultraviolet wavelength area. In the present invention, it is preferred to form a layer containing a polymer having an ultraviolet ray absorption structure on a thermosensitive layer to prevent the background discolorization caused by irradiation of light.

There is no specific limit to the layer containing a polymer having an ultraviolet ray absorption structure as long as the layer can be formed on a thermosensitive layer. An intermediate layer or a protective layer mentioned below can be used as a layer containing a polymer having an ultraviolet ray absorption structure.

The polymer having an ultraviolet ray absorption structure represents a polymer having an ultraviolet absorption group in its molecule. Specific examples of the ultraviolet ray absorption structure include a salicylate structure, a cyanoacrylate structure, a benzotriazol structure, and a benzophenon structure. Among them, a benzotriazol structure and a benzophenon structure are especially preferred.

There is no specific limit to the polymer having an ultraviolet ray absorption structure. Any polymer can be selected depending on purposes. Specific examples of such polymers include a copolymer of 2-(2'-hydroxy-5'-methacryloxyethylphenyl)-2H-benzotriazol, 2-hydroxyethyl methacrylate, and styrene, a copolymer of 2-(2'-hydroxy-5'-methyl phenyl) benzotriazol, 2-hydroxypropyl methacrylate and methyl methacrylate, a copolymer of 2-(2'-hydroxy-3'-t-butyl-5'-methyl phenyl)-5-chlorobenzotriazol, 2-hydroxyethyl methacrylate, methyl methacrylate, and t-butyl methacrylate, and a copolymer of 2,2,4,4-tetrahydroxy benzophenon, 2-hydroxypropyl methacrylate, styrene, methyl methacrylate and propyl methacrylate.

It is preferred that the polymer having an ultraviolet ray absorption structure is cross linked in the layer to which the polymer is added. Therefore, it is especially preferred that the polymer having an ultraviolet ray absorption structure has a group such as hydroxyl group, amino group, and carboxyl group which performs cross-linking reaction with a curing resin.

With regard to the curing resin, curing resins which perform a cross linking reaction with the polymer having an ultraviolet ray absorption structure are widely used and isocyanate based curing resins are especially preferred. The isocyanate based curing resins are polyisocyanate compounds having multiple isocyanate groups. Specific examples of such curing resin include hexamethylene diisocyanate (HDI), thrylene diisocyanate (TDI), xylylene diisocyanate UXDI), isophorone diisocyanate (IPDI), adduct types, biuret types, and isocyanurate types formed based on trimethylol propane thereof, and blocked isocyanates. Among these, hexamethylene diisocyanate is preferred and adduct types, biuret types, and isocyanurate types thereof are particularly preferred.

There is no specific limit to the addition amount of the curing agent mentioned above as long as the amount thereof satisfies the durability of a reversible thermosensitive recording medium. It is possible to determine the amount thereof depending on purposes. The molar ratio of the number of active groups in the curing resin to the number of hydroxyl groups in the polymer mentioned above is preferably 0.3 to 2.0, and more preferably 0.8 to 1.5. When the molar ratio is not less than 0.3, the heat resistance is improved so that the durability of a reversible thermosensitive recording medium can be improved. To the contrary, when the molar ratio is not greater than 2.0, colorization characteristics and decolorization characteristics are improved, which is preferred.

The reversible thermosensitive recording medium mentioned above preferably contains an ultraviolet ray absorption agent in light of further prevention of background decolorization. There is no specific limit to the selection of a layer to which the ultraviolet ray absorption agent is added. Any layer can be selected based on purposes. For example, a layer having a polymer having an ultraviolet ray absorption structure, a thermosensitive layer, a protective layer and an intermediate layer can be selected.

There is no specific limit to the selection of the ultraviolet ray absorption agents. Any ultraviolet ray absorption agent can be selected depending on purposes. For example, salicylic acid based compounds, benzophenon based compounds, benzotriazol based compounds can be selected. Specific examples of such compounds include phenyl salicylate, monoglycol salicylate, p-t-butylphenol salicylate, 2-hydroxy-4-methoxybenzophenon, 2-hydoxy-4-methoxydibenzophenon, 2-hydroxy-4-octoxybenzophenon, 2(2'-hydroxy-5'-methyl phenyl)benzotriazol, 2(2'-hydroxy-3',5'-di-t-butylphenyl)benzotriazol, 2(2'-hydroxy-3'-t-butyl-5'-methylphenyl)benzotriazol, resorcinol monobenzoate, and 2'-ethylhexyl-2-cyano-3-phenyl cinnamate.

Substrate

There is no specific limit to the form, structure and dimensions of the substrate mentioned above. Any substrate can be selected according to purposes. For example, a plate form can be selected, and a single layer structure or multiple layer structure can be selected. The dimension thereof can be selected according to the size of a reversible theremosensitive recording medium.

Inorganic materials and organic materials can be used as the material for the substrate mentioned above. Specific examples of such inorganic materials include glass, quartz, silicon, silicon oxide, aluminum oxide, $SiO_2$, and metals. Specific examples of such organic materials include paper, cellulose derivatives such as cellulose triacetate, synthesized paper, polyethylene terephthalate, polycarbonate, polystyrene, and polymethyl methacrylate. These can be used alone or in combination. Among these, to obtain a sheet having a highly clear image, polyethylene terephthalate and PET-G film are especially preferred for a substrate to have a haze degree of not greater than 10%, regulated by JISK7105 (Testing methods for optical properties of plastics).

It is preferred to improve the characteristics of the surface of the substrate mentioned above by, for example, corona discharging treatment, oxidation reaction treatment (chromic acid, etc.), etching treatment, easy attachment treatment, and anti-charging treatment to improve the attachment property between the substrate and a coated layer. In addition, it is preferred to make the color of the substrate white by adding a white dye such as titanium oxide.

There is no specific limit to the thickness of the substrate. The thickness thereof can be selected according to purposes and is preferably from 10 to 2,000 μm, and more preferably from 20 to 1,000 μm.

The substrate can have a magnetic thermosensitive layer on either side or both sides of a thermosensitive layer. In addition, the reversible thermosensitive recording medium can be attached to another medium with an adhesive layer therebetween.

<Undercoating Layer>

There is provided an undercoat layer between a substrate and a thermosensitive layer to upgrade sensitivity while effectively using the heat applied to a reversible thermosensitive recording medium, to improve the adhesive property between the substrate and the thermosensitive layer, or to prevent infiltration of the material contained in the thermosensitive layer to the substrate. Such an undercoat layer contains at least hollow particles, and a binder resin and other materials if necessary.

Specific examples of such hollow particles include hollow particles having one hollow portion therein, and hollow particles having multiple hollow portions therein. These can be used alone or in combination.

There is no specific limit to the material for use in the hollow particles. Such hollow particles can be suitably selected according to purposes. A preferred example thereof is a thermoplastic resin. Such hollow particles can be prepared accordingly or marketed products thereof can be used. Specific examples of such marketed products include MICROSPHERE R-300 (manufactured by Matsumoto Yushi-Seiyaku Co., Ltd., ROPAQUE®HP1055and HP433J (manufactured by Zeon Corporation), and SX886 (manufactured by JSR Corporation).

There is no specific limit to the addition amount of the hollow particles mentioned above to an undercoat layer. The addition amount thereof can be determined based on purposes and, for example, is preferably from 10 to 80 weight %.

The resins for use in the thermosensitive layer mentioned above or the layer having a polymer having an ultraviolet ray absorption structure mentioned above can be used as the binder resin for use in an undercoat layer.

In addition, an undercoat layer can contain at least one of an inorganic filler such as calcium carbide, magnesium carbide, titanium oxide, silicon oxide, aluminum hydroxide, kaolin and talc, and various kinds of organic fillers.

The undercoat layer can contain other agents such as lubricants, surfactants, and dispersants.

There is no specific limit to the layer thickness of such an undercoat layer. The layer thickness thereof can be determined according to purposes and, for example, is preferably from 0.1 to 20 μm and more preferably from 0.5 to 5 μm.

Protective Layer

The protective layer mentioned above contains a binder resin, a release agent, and an ultraviolet ray absorption agent, and other agents if necessary.

The resins for use in the thermosensitive layer mentioned above or the layer having a polymer having an ultraviolet ray absorption structure mentioned above can be used as the binder resin for use in a protective layer. Among these, resins which can be cured on exposure to heat, ultraviolet ray, or electron beam are preferably used. Among them, thermal curing resins are preferred and ultraviolet ray curing resins are more preferred.

Specific examples of the release agent mentioned above include silicone having a polymeric group, a silicone grafted polymer, wax, zinc stearate, and silicone oil.

The addition amount of the release agent is preferably from 0.01 to 50 weight % and more preferably from 0.1 to 40 weight % based on the total weight of the resin in the protective layer mentioned above. The release agent is effective in a small amount but when the amount thereof is too small, it is hard to obtain the effect. When the amount thereof is too large, a problem, such as deterioration of the adhesive property to the undercoat layer, arises.

The ultraviolet ray absorption agent for use in the layer having a polymer having an ultraviolet ray absorption structure mentioned above can be used as the binder resin for use in the protective layer. Among them, organic ultraviolet ray absorption agents are particularly preferred.

The addition amount of the ultraviolet ray absorption agents is preferably from 0.5 to 10 weight % based on the total amount of the resin in a protective layer.

The protective layer mentioned above can contain additives such as known surfactants, leveling agents, and anti-charging agents.

As the solvent for use in the application liquid of a protective layer, a dispersion device of applying the application liquid, a method of applying thereto, drying/curing a protective layer, etc., those for use in the thermosensitive layer can be used.

The layer thickness of the protective layer mentioned above is preferably from 0.1 to 20 μm, more preferably from 0.5 to 10 μm, and further preferably from 1.5 to 6 μm. When the layer thickness is too thin, the protective layer does not have sufficient durability and resultantly is broken when images are repetitively printed and erased. In addition, such a protective layer is easy to be chemically damaged so that the function of a reversible thermosensitive recording medium maybe lost. When the layer thickness is too thick, only blurred images having a poor representation property (fine level of a printed image) can be obtained. In addition, the energy consumed to print and erase an image inevitably increases for a protective layer having too thick a layer due to the thermal conductivity thereof, which may lead to an extra burden for a device.

Intermediate Layer

It is preferred to provide an intermediate layer to improve the adhesive property between the thermosensitive layer and the protective layer, to prevent the deterioration of the thermosensitive layer on account of application of the protective layer, and to prevent the additives contained in the protective layer from moving to the thermosensitive layer. Thereby, the preservability of a colorized image can be improved.

The intermediate layer mentioned above contains a binder resin and an ultraviolet absorption agent and other materials if necessary.

The resins for use in the thermosensitive layer mentioned above can be used as resins for use in the protective layer. Among these, by adding a curing resin, it is possible to further improve the heat resistance of a reversible thermosensitive recording medium and obtain good durability thereof for repetitive use.

The ultraviolet ray absorption agents for use in a layer having a polymer having an ultraviolet ray absorption structure can be used in the protective layer. For example, specific examples of organic ultraviolet ray absorption agents include benzotriazol based compounds, benzophenon based compounds, salicylic acid ester compounds, cyanoacrylate based compounds and cinnamate based compounds. Among these, benzotriazol compounds are preferred.

The content of the ultraviolet ray absorption agents is preferably from 0.5 to 80 parts by weight based on 100 parts by weight of the resin in an intermediate layer.

In addition, the intermediate layer may contain ultraviolet ray absorptive or shielding inorganic compounds, and known surfactants, leveling agents and anti-charge agents as additives.

As the solvent for use in the application liquid for an intermediate layer, a dispersion device of applying the application liquid thereto, a method of applying, drying/curing an intermediate layer, etc., those for use in the thermosensitive layer and the protective layer can be used.

There is no specific limit to the reversible thermosensitive recording medium of the present invention with regard to its dimension and form. The medium can be processed to have a card form, a sheet form, a label form, a roll form, etc.

A reversible thermosensitive recording medium having a card form can be applied to prepaid cards, reward cards, and further credit cards. A reversible thermosensitive recording medium having a sheet form having a document size such as A4 can be applied to sample printing using a printing/erasing device. Further, the printable area of a medium having such a sheet form, which is naturally larger than a card size, is so large that the medium can be applied to a temporary output use such as an order form of a process control, circulation documents, meeting materials, etc.

Further, a medium processed to have a roll form can be assembled in a device having a printing/erasure portion. Therefore, such a medium can be used for display boards, notice boards, or electronic black boards. Such display boards can be preferably used in a clean room because such boards do not produce dusts.

The reversible thermosensitive recording medium of the present invention may include an irreversible thermosensitive recording layer. In this case, the color tone of the colored irreversible thermosensitive recording layer may be the same as or different from that of the colored reversible thermosensitive recording layer.

In addition, the recording medium can include a print layer including images such as character images, pictorial images, photograph images and images detected by infrared light. The print layer may be located on the same side as or the side opposite that bearing the recording layer. The print layer may be located on a portion of a surface or the entire surface of the recording medium. The print layer can be formed by a method such as offset printing, gravure printing, inkjet printing, thermal transfer printing or other image processing methods. A portion of or the entire the print layer may be covered with an OP varnish layer.

In addition, each of the layers mentioned above can be colored using a colorant such as dyes and pigments.

Further, the recording medium can include a hologram for security. Furthermore, a registered design or the like such as portraits, company marks, and symbol marks may be formed using a relief technology or a sunk relief technology.

Image recording and erasing can be performed using known image processing apparatus which can record and/or erase an image in reversible thermosensitive recording media. However, it is preferred to use the image processing apparatus of the present invention, which is described below.

The image processing apparatus of the present invention preferably has an image recording device and an image erasing device. An image processing apparatus including an image recording/erasing device which can perform both image recording and image erasing is more preferred because image erasing and image recording can be performed at a high speed. Thermal printheads can be preferably used as the image recording/erasing device. Specifically, by changing the energy applied to the thermal printhead, image recording and erasing can be performed at the same time. Alternatively, an image processing apparatus using a thermal printhead as an image recording device and another heating device such as contact heating devices (e.g., thermal printheads, ceramic heaters in which a heating element is printed on an alumina substrate by a screen printing method, hot stamps, heat rollers and heat blocks), or non-contact heating devices (e.g., hot air blowers and infrared irradiators) can also be used.

Reversible Thermosensitive Recording Device

The reversible thermosensitive recording device of the present invention includes an information storage portion and a reversible display portion. The reversible display portion includes the reversible thermosensitive recording medium of the present invention and, further, other members if necessary.

By (integrally) providing an information storage portion and a thermosensitive layer on which an image can be can reversibly displayed in one card, part of the stored information in the information storage portion can be displayed on the themosensitive layer. Thereby, an owner of such a card can confirm the information by just looking at the card without a dedicated device. Therefore, a card having such a structure is convenient to users. In addition, it is possible to repetitively use a reversible thermosensitive recording medium by rewriting the display of the reversible thermosensitive recording portion when the content in the information storage portion is rewritten.

A device having the information storage portion and the reversible display portion can be typified into the following two:

(1) a device in which a thermal layer is directly formed on part of the portion having an information storage portion serving as a substrate of a reversible thermosensitive recording medium; and (2) a device in which a reversible thermosensitive recording medium formed of a substrate and a thermosensitive layer thereon is attached to the portion having an information storage portion.

In both (1) and (2), when each of the information storage portion and the reversible display portion is set to properly function, there is no specific limit to the position of an information storage portion. For example, an information storage portion can be provided to the other side of the side of a substrate on which a thermosensitive layer is formed in a reversible thermosensitive recording medium, between a substrate and a thermosensitive layer, or on part of a thermosensitive layer.

Known memories can be used for the information storage portion. Specific examples of the memories include magnetic recording layers, magnetic stripes, IC memories, optical memories, RF-ID (Radio Frequency Identification) tags, holograms, etc. When the recording medium has a size larger than the card size, IC memories, and RF-ID tags are preferably used. The RF-ID tags include an IC chip and an antenna connected with the IC chip.

The magnetic thermosensitive layer is applied and formed on a substrate typically using iron oxide and barium ferrite with vinyl chloride or urethane based resins, etc., or deposited/sputtered thereon without using a resin. The magnetic thermosensitive layer can be provided to the other side of the side of a substrate on which a thermosensitive layer is formed in a reversible thermosensitive recording medium, between a substrate and a thermosensitive layer, or on part of a thermosensitive layer. In addition, reversible thermosensitive material for use in display can be used in a form of bar codes, two-dimensional bar codes as storage portion.

The holograms mentioned above are preferably a rewritable type. For example, a rewritable hologram in which coherent light is written in polymer azobenzene amorphous film can be used.

As a member having the information storage portion, cards, discs, disc cartridges and cassette tapes can be used. Specific examples of such members include thick cards such as IC cards and optical cards, disc cartridges including a rewritable disc such as flexible disks FDs), magnetic optical discs (MDs), and DVD-RAMs, discs such as CD-RWs which do not use a disc cartridge, write-once discs such as CD-Rs, optical information recording media (CD-RWs) formed of a phase change recording material, and video cassettes.

A member having both reversible display portion and information storage portion can be provided. For example, a card having such a structure can display part of information stored in the information storage portion. Thereby, an owner of the card can confirm the information by just looking at the card without a dedicated device. As a result, such a card is extremely convenient in comparison with a card without a reversible thermosensitive recording medium.

There is no specific limit to the information storage portion mentioned above. The information storage portion can be selected to purposes as long as the information storage portion can store information. Magnetic recording, contact-type ICs, non-contact-type ICs, and optical memory are preferably used.

The magnetic thermosensitive layer mentioned above is applied and formed on a substrate typically using iron oxide and barium ferrite with vinyl chloride, urethane based, or nylon-based resins, etc., or deposited/sputtered thereon using the metal compounds mentioned above without a resin. In addition, a thermosensitive layer in a reversible thermosensitive recording medium for use in display can be used as a storage portion in a form of bar codes, and two-dimensional bar codes.

In addition, preferred examples of the reversible thermosensitive recording label, the reversible thermosensitive recording device, the image processing apparatus, and image processing method of the present invention will be described. In the description below, the surface of the reversible thermosensitive recording medium represents the surface of the side of the recording medium on which the reversible thermosensitive recording layer is present. The surface represents not only that of a protective layer, but also all or part of the surface which contacts with a thermal head when erasing printed characters.

As mentioned above, the theremosensitive recording medium of the present invention includes a thermosensitive layer and an information storage portion. One of the suitable materials for use in the information storage portion is an RF-ID tag.

Figure 2:
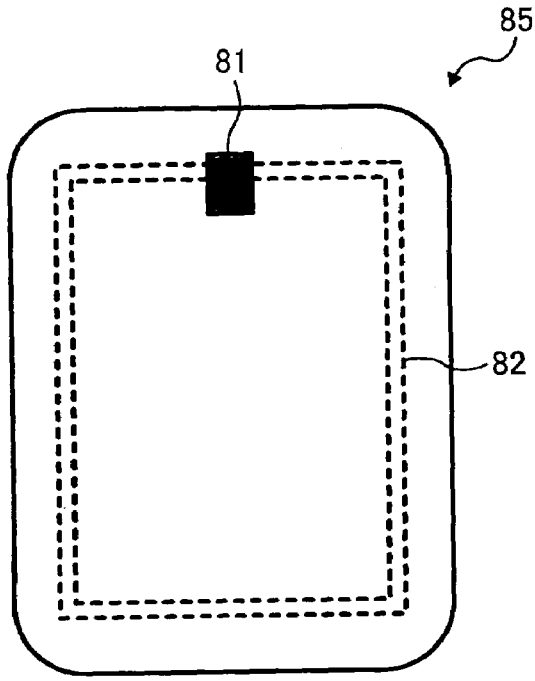
FIG. 2 is a schematic view illustrating an example of the RF-ID tag for use in the reversible thermosensitive recording device of the present invention.

FIG. 2 is a schematic view illustrating an RF-ID tag. An RF-ID tag 85 has an IC chip 81 and an antenna 82 connected with the IC chip 81. The IC chip 81 has a storage section, a power source controller, a transmitter and a receiver, each of which plays respective functional roles to perform communications. Data are transmitted between the RF-ID tag 85 and an antenna of a reader/writer over electric wave. Specifically, when the antenna 82 of the RF-ID tag 85 receives an electric wave from the reader/writer, the RF-ID tag generates a voltage by electromagnetic induction caused by resonance. Thereby, the IC chip 81 in the RF-ID tag 85 is activated, and converts the stored information to signals. Then the IC chip 81 transmits the signals to the reader/writer. The antenna of the reader/writer receives the signals, and the data processor thereof recognizes and performs data processing using software.

Figure 3:
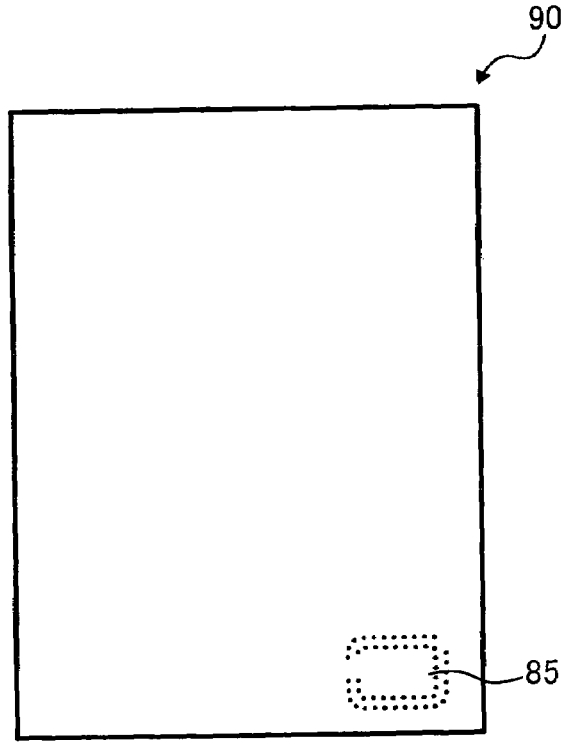
FIG. 3 is a schematic view illustrating an example of the reversible thermosensitive recording device of the present invention having an RF-ID tag on the backside thereof.

The RF-ID tag 85 has a form of a label or a card, and can be adhered to a thermosensitive recording medium 90 of the present invention, as illustrated in FIG. 3. In this case, the RF-ID tag 85 can be adhered to the recording layer side and is preferably adhered to the backside of the recording device. Known adhesives can be used to bond the RF-ID tag 85 and the thermosensitive recording medium.

FIG. 4 illustrates an industrial rewritable sheet 90 (i.e., a reversible thermosensitive recording device) to which the recording medium of the present invention is applied. As illustrated in FIG. 4A, a rewritable display portion is provided on the front side of the thermosensitive layer. Although the industrial rewritable sheet does not necessarily have an RF-ID tag on its back as illustrated in FIG. 4B, it is preferred to attach an RF-ID tag thereto as illustrated in FIG. 3 considering the convenience.

Figure 5:
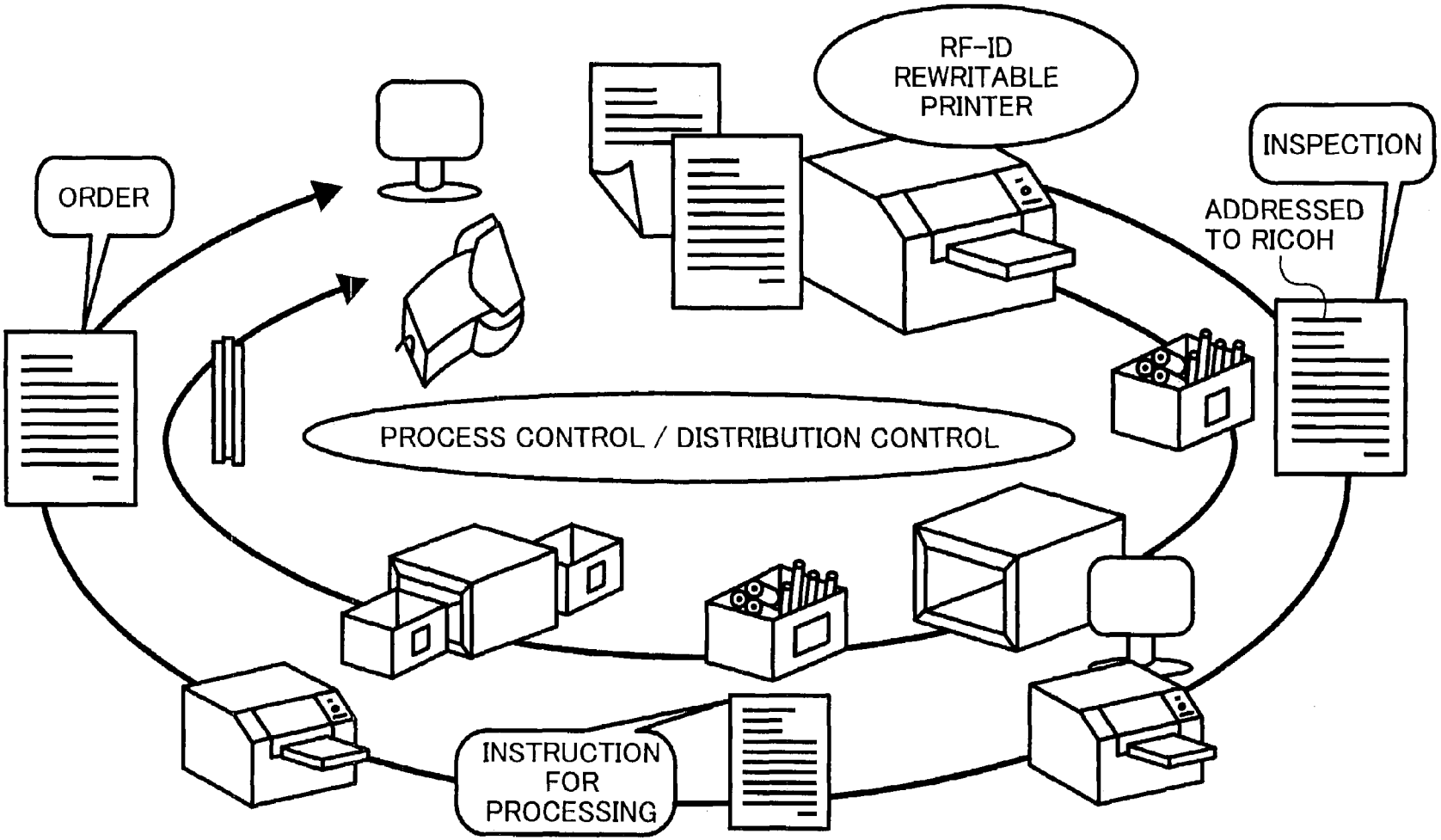
FIG. 5 is a schematic view illustrating how the reversible thermosensitive recording medium illustrated in FIG. 4 is used.

FIG. 5 is a schematic diagram illustrating an example of how an industrial rewritable sheet 90 including the reversible thermosensitive recording medium of the present invention, i.e., a rewritable sheet, and an RF-ID tag is used in a process control/distribution control system. In the beginning, information such as a name and quantity on the raw materials delivered is recorded in the rewritable sheet and the RF-ID tag. The sheet is attached to a returnable container for inspection. An instruction for processing is issued in the next process to the delivered raw materials and recorded in the rewritable sheet and the RF-ID tag to form an instruction sheet. After the delivered raw materials are processed according to the instruction sheet, order information is recorded on the rewritable sheet and the RF-ID tag. The rewritable sheet and the RF-ID tag are attached to the processed materials, i.e., a product, as an order instruction sheet. After the product is shipped, the rewritable sheet is retrieved. The shipment information is read and used as a delivery slip again.

Reversible Thermosensitive Recording Label

The reversible thermosensitive recording medium having a label form (hereinafter occasionally referred to as the recording label) has the recording medium and an adhesive layer. The adhesive layer is formed on the other side from the side on which an image is formed on the recording medium. The recording label can have other layers mentioned above for use in the recording medium. When a thermosensitive recording medium having a melting adhesive property upon application of heat is used as a substrate, the thermosensitive recording medium does not necessarily have an adhesive layer on its back.

There is no specific limit to the form, the structure and the dimensions of the adhesive layer. Any adhesive layer can be suitably formed according to purposes. For example, an adhesive layer having a sheet form or a film form can be used. Also an adhesive layer having a single-layered structure or a multiple-layered structure can be used. The size of an adhesive layer can be larger or smaller than the size of the thermosensitive layer.

There is no specific limit to materials for use in the adhesive layer. Any material can be selected according to purposes. Specific examples of such materials include urea resins, melamine resins, phenolic resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylate resins, methacrylate resins, natural rubbers, cyanoacrylate resins, silicone resins, etc. These resins can be used alone or in combination. In addition, the adhesive may be a hot-melt type adhesive or a liquid-type adhesive.

The reversible thermosensitive recording label is typically adhered to a substrate sheet such as a card. The reversible thermosensitive recording label can be attached to the substrate sheet on its entire or partial surface. Also, the reversible thermosensitive recording label can be provided to either or both sides of the substrate sheet and selected according to purposes.

There is no specific limit to the form, the structure and the dimension of the substrate sheet. Any substrate sheet can be selected according to purposes. For example, a substrate sheet having a plate form can be used. Also a substrate sheet having a single-layered structure or a multiple-layered structure can be used. The dimension thereof can suitably selected according to the dimension of the thermosensitive recording medium. For example, a sheet formed of a material such as polymer containing chloride, polyester resins, and biodegradable plastic resins can be used and a multiple-layered sheet thereof can be used.

There is no specific limit to the selection of the polymer containing chloride. The polymer containing chloride can be selected according to purposes. Specific examples of such polymers containing chloride include polyvinyl chloride, copolymers of vinyl chloride and vinyl acetate, copolymers of vinyl chloride, vinyl acetate, and vinylalcohol, copolymers of vinyl chloride, vinyl acetate and maleic acid, copolymers of vinyl chloride and acrylate, polyvinylidene chloride, copolymers of vinylidene chloride and vinyl chloride, and copolymers of vinylidene chloride and acrylonitrile.

Specific examples of the polyester resins mentioned above include polyethylene terephthalate (PET) resins, polybutylene terephthalate (PBT) resins, condensed ester resins (e.g., PETG®, manufactured by Eastman Chemical Company) formed of an acid such as terephthalate, and isophthalate and an alcohol such as ethylene glycol and cyclohexanedimethanol.

Specific examples of the biodegradable plastic resins include polylatic acid based resins, natural polymer based resins formed of amylum, a modified polyvinyl alcohol, etc., and microscopic organism produced resins formed of β-hydroxy butyric acid and β-hydroxy valeric acid. Further, other specific examples thereof include synthetic resin sheet or synthetic paper formed of polyacetate resins, polystyrene (PS) resins, epoxy resins, polyvinyl chloride (PVC) resins, polycarbonate (PC) resins, polyamide resins, acrylic resins, silicone resins, etc. These materials can be used in combination and accumulated.

One of specific examples of the multiple-layered structure is: An accumulated structure containing a core sheet and oversheets on both sides thereof. The core sheet is formed of two accumulated white polyvinyl chloride resin sheets, each of which has a thickness of 250 μm. The oversheet is formed of a transparent polyvinyl chloride resin sheet having a thickness of 100 μm. Another example thereof is an accumulated structure containing a core sheet and oversheets on both sides thereof. The core sheet is formed of two accumulated white PETG sheets, each of which has a thickness of 250 μm. The oversheet is formed of a transparent PETG having a thickness of 100 μm.

Figure 6:
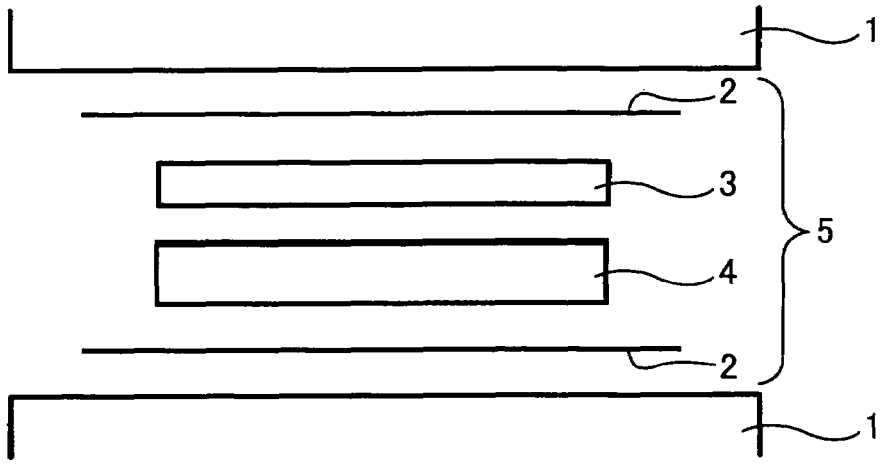
FIG. 6 is a schematic view illustrating an example of the thermocompression process of the reversible thermosensitive recording label of the present invention and a substrate sheet.

One of specific examples of the methods of attaching the substrate sheet and the reversible thermosensitive recording label is as follows as illustrated in FIG. 6: Accumulate a reversible thermosensitive recording label 3 and a substrate sheet 4: Sandwich these two with two mirror plates 2: and press these with a heat plate 1 upon application of heat.

Figure 7:
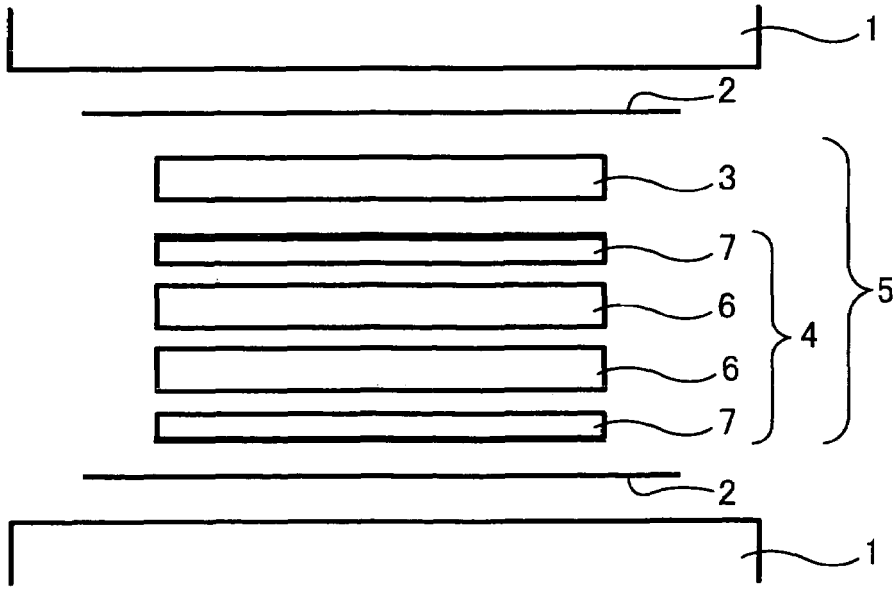
FIG. 7 is a schematic view illustrating another example of the thermocompression process of the reversible thermosensitive recording label of the present invention and a substrate sheet.

Further, another substrate sheet 4 as illustrated in FIG. 7 can be used in place of the substrate sheet 4 as illustrated in FIG. 6.

Thermocompression is performed using a known device such as a heat presser including the heat plate 1 at a temperature of from 80 to 170° C. and more preferably from 90 to 150° C. under pressure of from 5 to 70 Kgf/cm$^2$ and more preferably from 10 to 50 Kgf/cm$^2$.

When an accumulation structure having a transparent sheet formed of polyvinyl chloride, a white sheet formed of polyvinyl chloride, a white sheet formed of polyvinyl chloride, and a transparent sheet formed of polyvinyl chloride is used as a substrate sheet, the heating temperature during thermocompression is preferably from about 130 to about 150° C. When an accumulation structure having a transparent PETG, a white sheet formed of PETG, a white sheet formed of PETG, and a transparent sheet formed of PETG is used as a substrate sheet, the heating temperature during thermocompression is preferably from about 100 to about 130° C.

In addition, a reversible thermosensitive recording label and a substrate sheet can be attached to each other such that the two can be thermally attached subsequent to preliminary thermoadhesion. The thermoadhesion is performed using a rubber roll, etc.

There is no specific limit to the conditions of thermoadhesion. Optimal conditions depend on a substrate sheet used. Typically, the thermoadhesion is performed at 90° C. to 130° C. for not longer than an hour, e.g., 10 to 50 minutes while pressing.

In the present invention, when a reversible thermosensitive recording label having a protective layer the surface of which has been roughened by filler, etc., is thermocompressed on a substrate sheet such as a card, the filler on the protective layer is pressed in the protective layer or the layer thereunder by the thermocompression, which leads to increase of the gloss of the surface. Thereby, the filler loses its effectiveness, resulting in deterioration of repetitive durability. Further, when recording and erasing are repeated in a state in which the gloss of the surface increases, the gloss of the recorded and/or erased portion decreases. Therefore, the difference of the gloss degree between the printed/erased portions and non-printed/erased portions is recognized as uneven gloss. In the present invention, a protective layer is provided to the reversible thermosensitive recording medium of the present invention to solve such a drawback. The surface roughness of the reversible thermosensitive recording medium is preferably not greater than 0.15 μm to obtain good gloss.

The reversible thermosensitive recording label having the adhesive layer can be attached to the entire or part of the surface of a thick substrate such as vinyl chloride card with magnetic stripes, to which the thermosensitive layer is difficult to apply. Thereby, part of the information magnetically stored can be displayed.

The reversible thermosensitive recording label can be substituted for a display label on thick cards such as IC cards and optical cards, disc cartridges including a rewritable disc such as flexible disks, magnetic optical discs (MDs), and DVD-RAMs, discs such as CD-RWs which do not use a disc cartridge, write-once discs such as CD-Rs, optical information recording media (CD-RWs) formed of a phase change recording material, and video cassette tapes.

Figure 8:
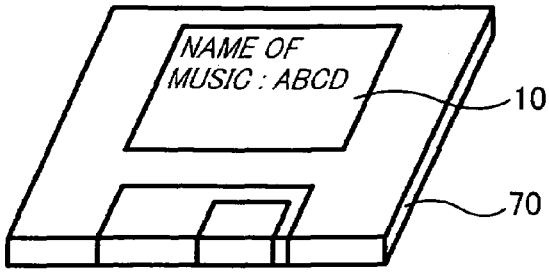
FIG. 8 is a schematic view illustrating an MD disk cartridge on which a label of the reversible thermosensitive recording medium of the present invention is attached.

As illustrated in FIG. 8, a recording label 10 of the present invention is adhered to an MD disc cartridge 70. It is possible to automatically rewrite the displayed information in the recording label when the information in the medium is changed. When a disc such as a CD-RW which does not use a disc cartridge is used, the reversible thermosensitive recording label of the present invention can be directly attached thereto.

Figure 9:
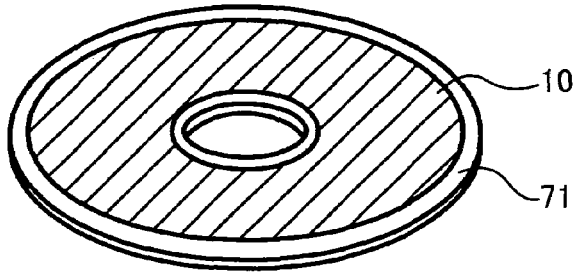
FIG. 9 is a schematic view illustrating a CD-RW on which a label of the reversible thermosensitive recording medium of the present invention is attached.

As illustrated in FIG. 9, the reversible thermosensitive recording label 10 can be directly adhered to a CD-RW 71, which does not use a disc cartridge. When the reversible thermosensitive recording label is attached to a write-once disc such as a CD-R, part of the information added to the CD-R can be displayed in the reversible thermosensitive recording label.

Figure 10:
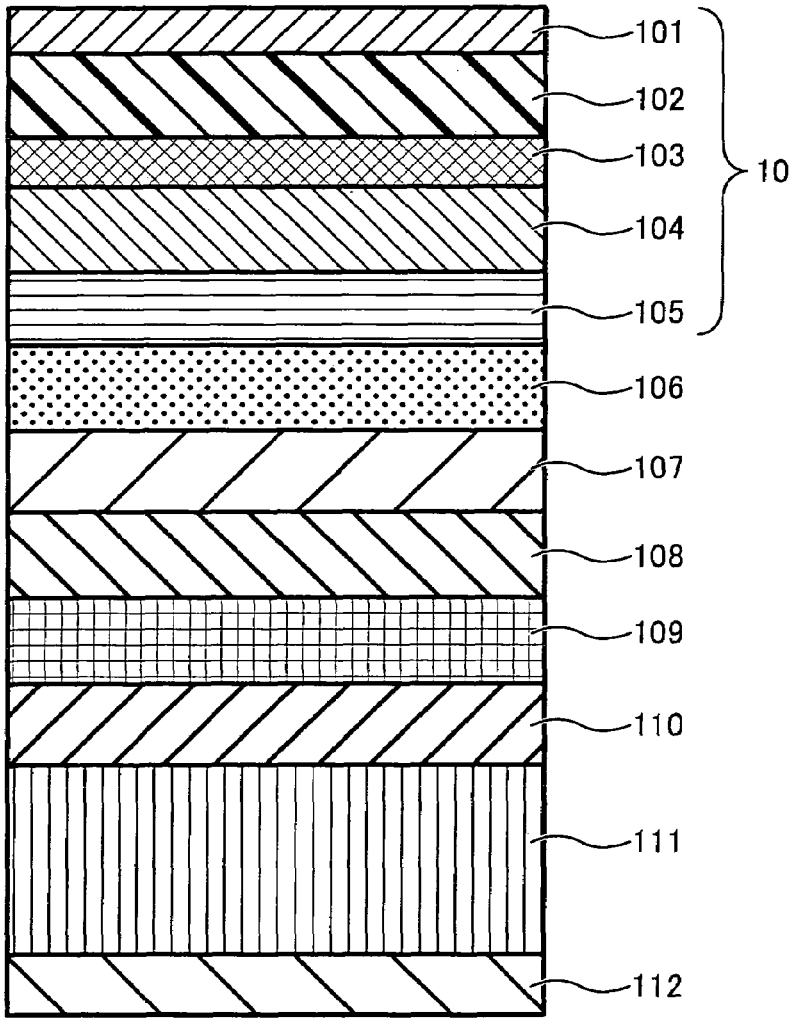
FIG. 10 is a schematic cross-sectional view of an optical information recording medium on which a label of the reversible thermosensitive recording medium of the present invention is attached.

FIG. 10 is a cross section illustrating an example of the phase change optical information recording medium (CD-RW) using a AgInSbTe type phase change material, on which the recording label 10 of the present invention is adhered. The CD-RW has a structure in which a first dielectric layer 110, an optical information storage layer 109, a second dielectric layer 108, a reflection layer 107, and an intermediate layer 106 are overlaid on a substrate 111. In addition, a hard coat layer 112 is formed on the opposite side of the substrate 111. The reversible thermosensitive recording label 10 of the present invention is adhered to the intermediate layer 106. The reversible thermosensitive recording label 10 includes an adhesive layer 105, a back layer 104, a support 103, a thermosensitive layer 102 and a protective layer 101. The CD-RW does not necessarily have the dielectric layer at both sides of the optical information storage layer 109. However, when a substrate formed of a material such as a polycarbonate resin having a low thermal durability is used, the first dielectric layer 110 is preferably provided.

Figure 11:
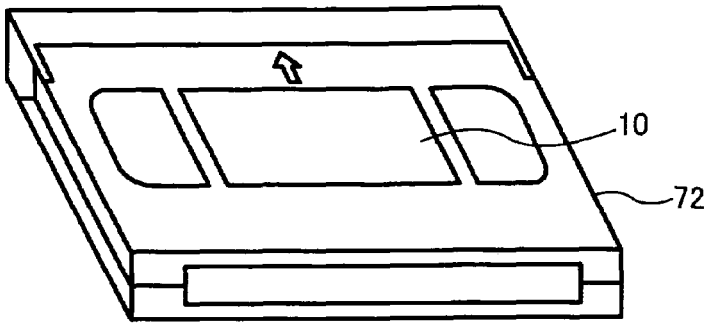
FIG. 11 is a schematic view illustrating a video cassette on which a label of the reversible thermosensitive recording medium of the present invention is attached.

FIG. 11 is a diagram illustrating an example of a video cassette 72 on which the recording label is adhered. It is possible to automatically rewrite the displayed information in the recording label 10 when the information in the video cassette 72 is changed.

In the examples mentioned above, the recording label is adhered to the media such as cards, discs, disc cartridges, and cassettes, but the method of adhering the recording medium is not limited thereto. For example, a method in which the recording medium is directly formed on the media by coating; or a method in which a recording medium formed on a support is transferred on the media can also be used. When the transfer method is used, an adhesive layer (such as hot-melt type adhesive layers) can be previously formed on the recording medium.

When information is recorded in the recording medium, which is adhered to such hard media as mentioned above, using a thermal printhead, it is preferred to form a cushiony layer between the hard media and the recording layer to enhance the contact between the surface of the recording medium and the thermal printhead.

Figure 12:
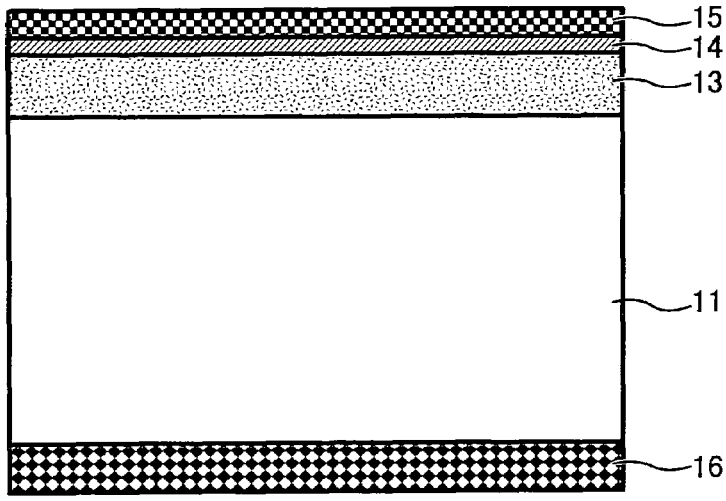
FIGS. 12 and 13 are schematic cross-sectional views of examples of the reversible thermosensitive recording medium of the present invention.
Figure 13:
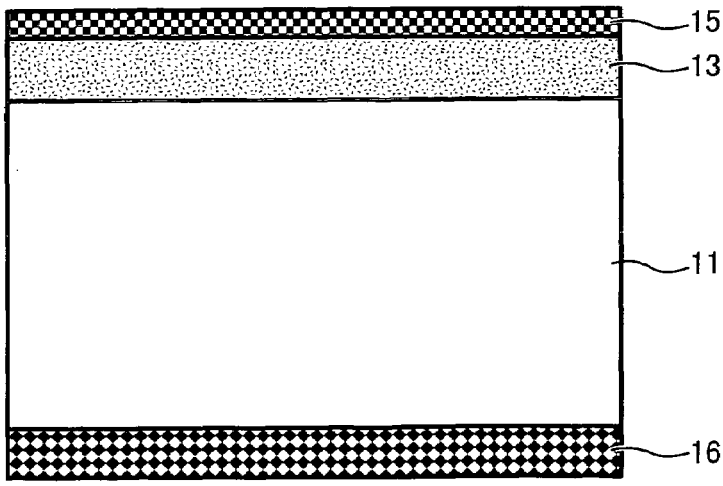

FIGS. 12 and 13 are schematic view illustrating the cross-section of embodiments of the recording medium of the present invention. In FIG. 12, a thermosensitive recording layer 13, an intermediate layer 14, and a protective layer 15 are formed on a substrate 11 and a back layer 16 is formed on the opposite side of the substrate 11. In FIG. 13, a recording layer 13, and a protective layer 15 are formed on a substrate 11 and a back layer 16 is formed on the opposite side of the substrate 11.

Figure 14A:
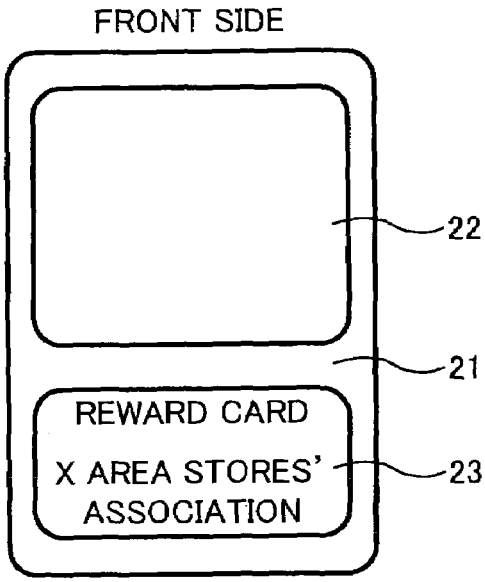
FIGS. 14A and 14B are schematic views of another example (a card) of the reversible thermosensitive recording medium of the present invention.
Figure 14B:
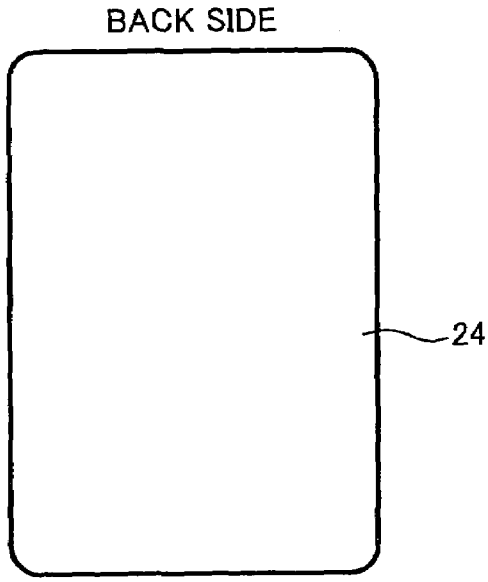

The recording medium having such a structure is preferably used for the industrial rewritable sheet having a RF-ID tag illustrated in FIG. 5. In addition, the recording medium can be preferably used for a card 21 having a print display portion 23 as illustrated in FIG. 14A. Numeral 22 denotes a rewritable display portion including the recording medium of the present invention. The backside of the card 21, which is illustrated in FIG. 14B, has a magnetic recording portion and a back layer 24 formed on the magnetic recording portion.

Figure 15A:
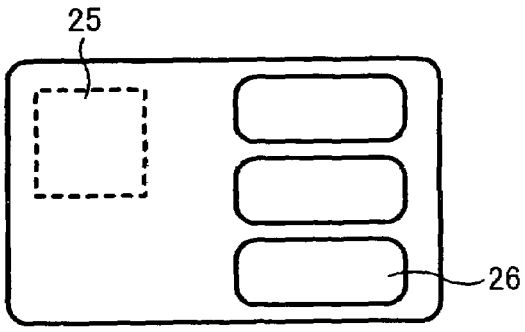
FIGS. 15A and 15B are schematic views of another card-form embodiment of the reversible thermosensitive recording medium of the present invention.
Figure 15B:
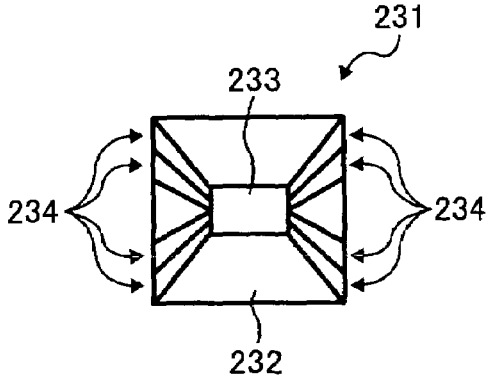

FIG. 15A illustrates an embodiment of the recording device (card) of the present invention. The recording device has a thermosensitive recording layer and a protective layer which are formed on a substrate. The recording device has a recessed portion 25, in which an IC chip is to be set, on the backside thereof, and a rewritable display portion 26 including the recording label of the present invention on the front side thereof. An embodiment of the IC chip to be set in the recessed portion 25 is illustrated in FIG. 15B. A wafer 231 includes a wafer substrate 232, and an integrated circuit 233 formed on the wafer substrate 232. A plurality of terminals 234 are provided on the backside of the wafer substrate 232. A printer (reader/writer) electrically contacts with the terminals 234 to read out or rewrite the information stored in the IC chip.

Figure 16A:
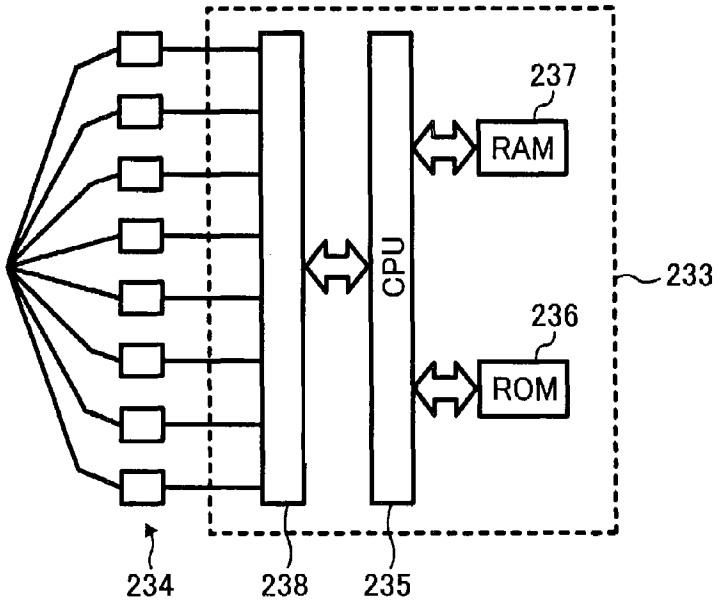
FIGS. 16A and 16B are a block diagram of an integrated circuit and a schematic view illustrating the information stored in the RAM of the integrated circuit.
Figure 16B:
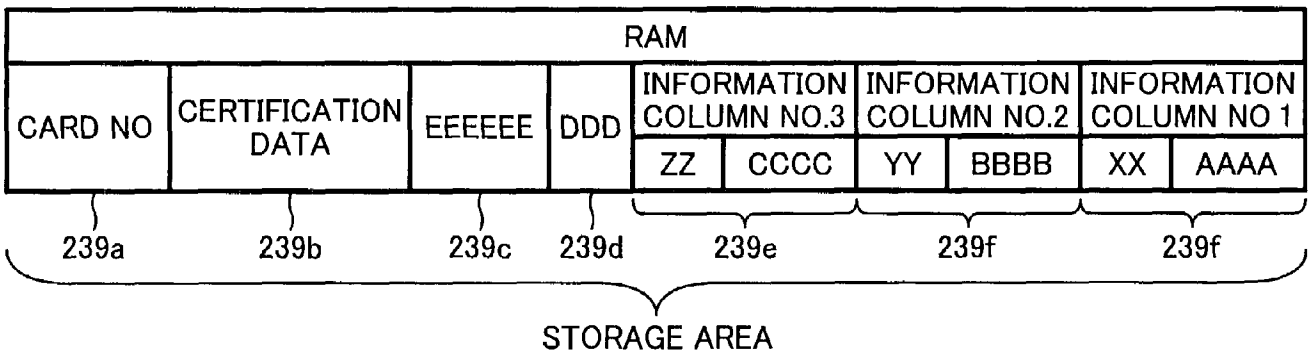

The function of the reversible thermosensitive recording will be described with reference to FIG. 16. FIG. 16A is a block diagram of the integrated circuit 233. FIG. 16B is a constitutional block diagram illustrating an embodiment of data stored in a RAM in the integrated circuit 233.

The integrated circuit 233 is constituted of, for example, an LSI including a CPU 235 which executes a controlling operation through a predetermined procedure, a ROM 236 which stores operational program data for the CPU 235, and a RAM 237 which writes and reads out data. In addition, the integrated circuit 233 has an input/output interface 238 which sends input data to the CPU 235 and outputs the signals output from the CPU 235. Further, the integrated circuit 233 has a power on reset circuit, a clock generation circuit, a pulse dividing circuit and an address decoder circuit, which are not shown.

The CPU 235 performs an interrupt control routine according to interrupt pulses provided by the pulse dividing circuit. The address decode circuit decodes the address data sent from the CPU 235, and sends signals to the ROM 236, RAM 237 and the input/output interface 238. The input/output interface 238 is connected with the plurality of terminals 234 (in FIG. 16, eight terminals). Data sent from a printer (reader/writer) is input to the CPU 235 via the terminals 234 and the input/output interface 238. When the CPU 235 receives the input signals, the CPU executes operations according to the program data stored in the ROM 236, and outputs data and signals to the reader/writer via the input/output interface 238.

As illustrated in FIG. 16B, the RAM 237 has a plurality of storage areas 239*a* to 239*g*. For example, the storage areas 239*a* and 239*b* store the card number, and data concerning the administrator of the card, respectively. The storage area 239*c* is a storage area to be used by the card owner or a storage area storing information on handling the card. The storage areas 239*d*, 239*e*, 239*f* and 239*g* store the former administrator and information concerning the former user, etc.

Image processing (i.e., image recording and/or erasing) can be performed on the reversible thermosensitive recording medium, label and device of the present invention by various image processing methods and apparatus. However, image processing can be preferably performed by the image processing apparatus mentioned below.

Image Processing Method and Image Processing Apparatus

The image processing apparatus of the present invention includes at least one of an image recording device configured to record an image and an image erasing device configured to erase an image in the recording medium of the present invention, and optionally includes other devices such as feeding devices and controlling devices.

The image processing method of the present invention includes at least one of the steps of erasing an image previously recorded in the recording medium and/or recording an image in the recording medium of the present invention, and optionally includes other steps such as feeding the recording medium and controlling the recording and/or erasing.

The image processing method of the present invention can be preferably performed using the image processing apparatus of the present invention. Namely, the image recording and erasing operations can be performed by the image recording device and the image erasing device, respectively, and the feeding operation and the controlling operation can be performed by the feeding device and the controlling device, respectively.

Image Recording Device and Image Erasing Device

The image recording device heats the recording medium to record an image therein. The image erasing device heats the recording medium to erase an image previously recorded therein.

The image recording device for use in the present invention is not particularly limited, and heating devices such as thermal printheads, and laser beam emitting devices can be used. These devices can be used alone or in combination.

The image erasing device is not also particularly limited, and heating devices such as hot stamps, ceramic heaters, heat rollers, heatblocks, hot airblowers, thermal printheads, and laser beam emitting devices can eb used. Among these devices, ceramic heaters are preferably used because the image processing apparatus can be minimized in size, and the recording medium can achieve a good erased state, resulting in formation of a high contrast image. The temperature of the ceramic heater is not particularly limited, but is generally not lower than 110° C., preferably not lower than 112° C., and more preferably not lower than 115° C.

When a thermal printhead is used as an erasing device, the image processing apparatus can be further reduced in size and in addition energy can be saved. In addition, it is possible to perform image erasing and recording using only one thermal printhead. In this case, the image processing apparatus can be further minimized. When one thermal printhead is used for image erasing and recording, a method in which a previously recorded image is erased and then a new image is recorded; or a method (i.e., an overwriting method) in which a new image is recorded in parallel with erasing of a previously recorded image while the heating energy is changed for the image erasing and recording is used. The overwriting method has an advantage such that the time needed for the image erasing and recording operations can be shortened.

When the recording device of the present invention is used as a recording medium, the image processing apparatus can include an information reading device and an information rewriting device.

Suitable feeding devices for use in the image processing apparatus include known feeding devices which can feed the recording medium and/or the recording device of the present invention, such as feeding belts, feeding rollers, and combinations of feeding belts and feeding rollers.

Suitable controlling devices for use in the image processing apparatus include known controlling devices which can control the image erasing operation, image recording operation, feeding operation, etc., such as sequencers, and computers.

The image processing apparatus and image processing method will be described with reference to FIGS. 17 to 19.

Figure 17:
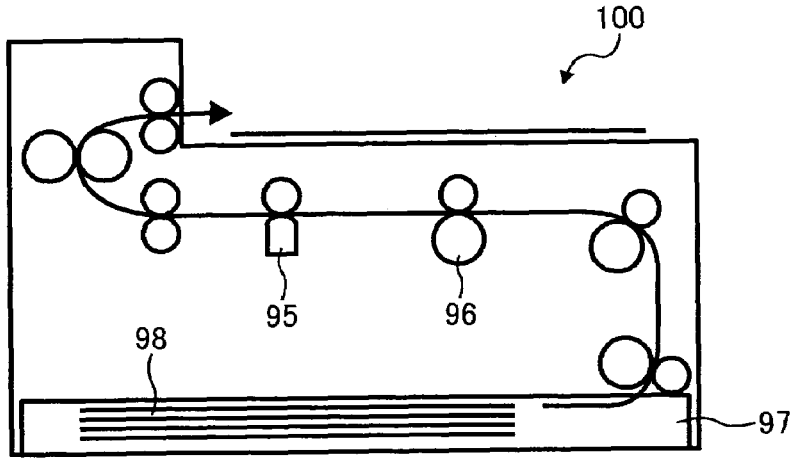
FIGS. 17, 18 and 19 are schematic views illustrating examples of the image processing apparatus of the present invention.

In FIG. 17, an image processing apparatus 100 includes a heat roller 96, a thermal printhead 95, a tray 97 containing recording sheets (rewritable sheets) 98 of the present invention. The recording layer of the recording sheet 98, which is fed from the tray 97, is heated with the heat roller 96 to erase a former image recorded therein. A new image is recorded in the recording layer with the thermal printhead 95.

Figure 18:
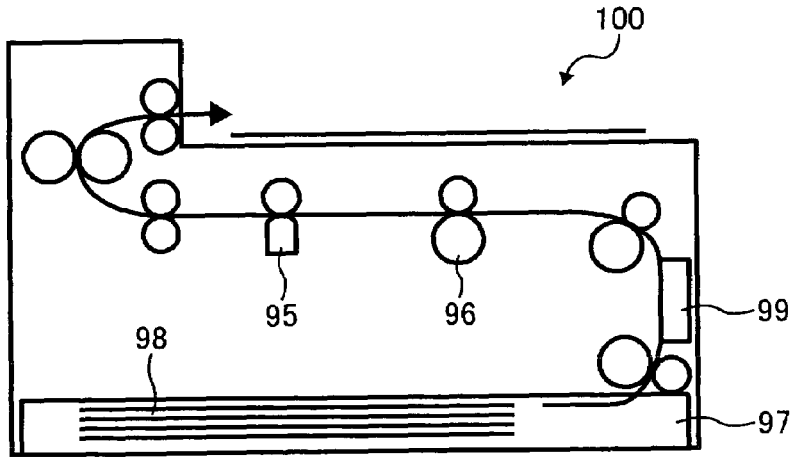
Figure 19:
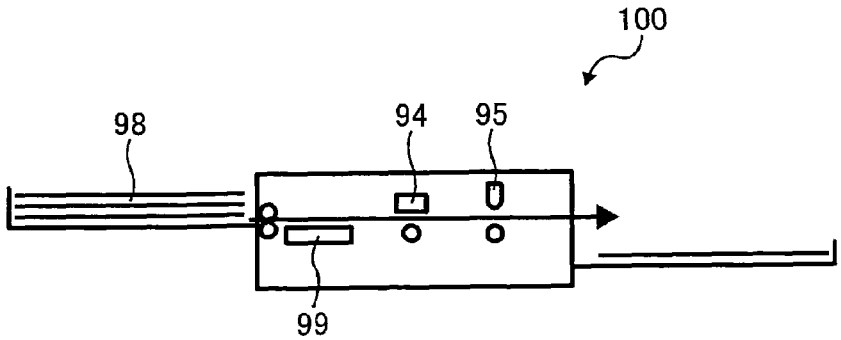

When a recording medium having a RF-ID tag is used, the image processing apparatus 100 can include an RF-ID reader/writer 99 as illustrated in FIGS. 18 and 19.

With reference to FIGS. 18 and 19, the reader/writer 99 of the image processing apparatus 100 reads the information stored in the RF-ID tag in the recording sheet 98, and records new information therein. Thereafter, the heat roller 96 (or a ceramic heater 94 in FIG. 19) heats the recording layer of the recording sheet 98 to erase an image previously recorded therein. Then the thermal printhead 95 records a new image in the recording layer of the recording sheet 98 according to the new information stored in the RF-ID tag.

It is possible to use a barcode reader or a magnetic head as the information reader instead of the RF-ID reader/writer 99. When a barcode reader is used, the barcode recorded in the recording layer in the recording sheet 98 is read with the barcode reader and then a new barcode image is recorded in the recording layer with the thermal printhead 95 according to the read information after the former barcode image and visual image are erased with the heat roller 96 (in FIG. 18) or the ceramic heater 94 (in FIG. 19).

The image processing apparatus 100 illustrated in FIGS. 17 and 18 has the tray 97 in which the recording sheets are stacked. The recording sheet 98 is fed one by one by a feeding method such as methods using a friction pad. The thus fed recording sheet is fed to the RF-ID reader/writer 99 by feeding rollers. The RF-ID reader/writer 99 reads and writes data in the RF-ID tag. The recording sheet 98 is fed to the heat roller 96 to erase the image recorded in the recording layer. The recording sheet is further fed to the thermal printhead 95 to record new image information in the recording layer. The recording sheet 98 is discharged from the image processing apparatus. The temperature of the heat roller 96 is preferably from 110 to 190° C., more preferably from 110 to 180° C., and even more preferably from 115 to 170° C.

FIG. 20 illustrates another embodiment of the image processing apparatus of the present invention.

Figure 20A:
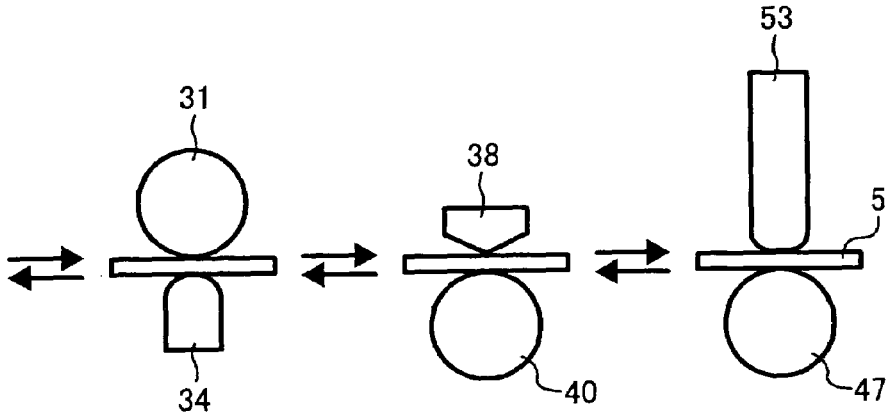
FIGS. 20A and 20B are schematic views of another example of the image processing apparatus of the present invention, which uses a ceramic heater and a thermal printhead as the image erasing device and the image recording device, respectively.

An image processing apparatus illustrated in FIG. 20A has a thermal printhead 53, a ceramic heater 38, a magnetic head 34, and feeding rollers 35, 44 and 52. The information recorded in the magnetic recording layer of a recording medium 5 is read with the magnetic head 34. The image previously recorded in the recording layer of the recording medium 5 is erased with the ceramic heater 38. Further, new image data are recorded in the recording layer of the recording medium 5 with the thermal printhead 53 based on the information read by the magnetic head 34. The recording medium 5 is discharged from the image processing apparatus. If desired, the recording medium 5 can be returned to the magnetic head 34 to rewrite the information in the magnetic recording layer after the recording medium 5 passes the nip between the thermal printhead 53 and the feeding roller 52 and/or the nip between the ceramic heater 38 and the feeding roller 44. Thus, the recording medium 5 can be fed back and forth as indicated by arrows, as illustrated in FIG. 20A. Rewriting the information in the magnetic recording layer can be performed after the image recording operation or the image erasing operation.

Figure 20B:
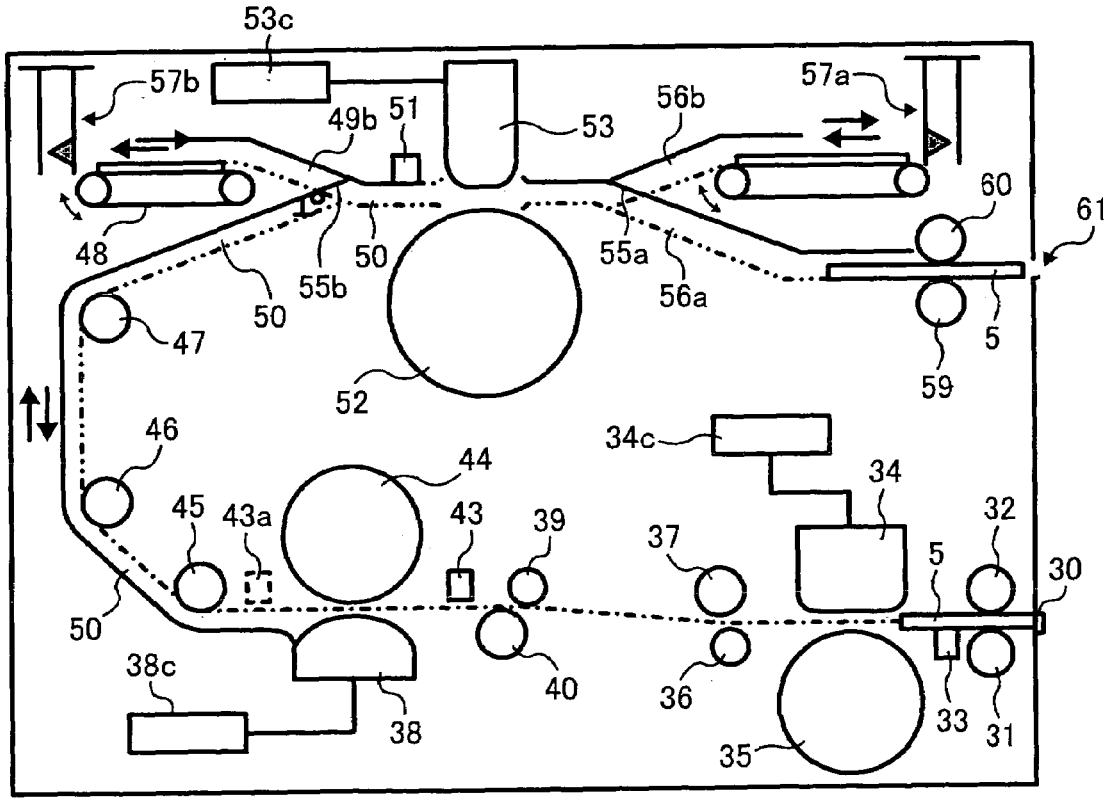

FIG. 20B illustrates another embodiment of the image processing apparatus of the present invention. A recording medium (thermosensitive recording medium) 5 of the present invention, which is inserted from an entrance/exit 30, is fed into the apparatus by a feeding roller 31 and a guide roller 32. When the recording medium 5 is detected and recognized with a sensor 33 and a controller 34*c*, the information is recorded in the magnetic recording layer or the information stored therein is erased with the magnetic head 34 while the recording medium 5 is pressed by a platen roller 35. The recording medium 5 is further fed by rollers 36 and 37 and rollers 39 and 40. When the recording medium 5 is detected and recognized with a sensor 43 and a controller 38*c*, the ceramic heater 38 heats the recording layer of the recording medium 5 to erase the image previously recorded therein. The recording medium 5 is fed by rollers 45, 46 and 47 along a passage 50, as illustrated by a chain double-dashed line. When the recording medium 5 is detected and recognized with a sensor 51 and a controller 53*c*, the thermal printhead 53 records a new image in the recording layer while the platen roller 52 presses the recording medium 5 toward the thermal printhead 53. The recording medium 5 is discharged by a feeding roller 59 and a guide roller 60 from the image processing apparatus through a passage 56*a* and an exit 61. The temperature of the ceramic heater 38 is preferably not lower than 110° C., more preferably not lower than 112° C. and even more preferably not lower than 115° C.

If desired, by changing the position of a passage changing member 55*a*, the recording medium 5 can be guided to a passage 56*b*. When the recording medium 5 presses a limit switch 57*a*, the recording medium 5 is fed backward by a feeding belt 58 which can move in both directions as indicated by arrows. The thus reversely fed recording medium 5 is subjected to an image recording treatment at the nip between the thermal printhead 53 and the platen roller 52. By changing the position of a passage changing member 55*b*, the recording medium 5 is guided to a passage 49*b*. When the recording medium 5 presses a limit switch 57*b*, the recording medium 5 is fed backward by a feeding belt 48 which can move in both directions as indicated by arrows. Then the recording medium 5 is fed again through the passage 56*a* and discharged by the feeding roller 59 and the guide roller 60 from the exit 61. Such a branched passage and a passage changing member can be provided on the both sides of the ceramic heater 38. It is preferred to provide a sensor 43*a* between the platen roller 44 and the feeding roller 45.

By using the image processing apparatus and method of the present invention and the recording medium of the present invention, which has a good light resistance, achieves a stable colored state and decolored state in which decolorization is almost complete, it is possible to form an image having a high color density.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention will be described with reference to Examples but not limited thereto.

Example 1

Manufacturing of Reversible Thermosensitive Recording Medium

Preparation of Thermosensitive Layer

The following components were pulverized and dispersed to obtain particles having an average particle diameter of 1.0 μm with a ball mill.

| | |
|---|---|
| Coloring developer represented by the following chemical structural formula 24 | 4 parts |
| Dialkylurea (HAKREEN SB, manufactured by Nippon Kasei Chemical Co., Ltd.) | 1 part |
| Acrylic polyol resin 40 weight % solution (LR327, manufactured by Mitsubishi Rayon Co., Ltd.) | 10 parts |
| Phenol based anti-oxidation agent (IRAGANOX 1520, manufactured by Ciba Specialty Chemicals) represented by the following chemical formula 25 | 0.06 parts |
| Methylethyl ketone | 80 parts |

Coloring developer

[Chemical formula 24]

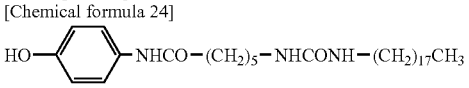

<IRGANOX 1520>

IRAGANOX 1520

[Chemical formula 25]

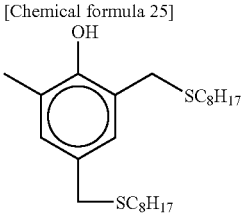

A thermosensitive layer application liquid was prepared by adding 1 part of 2-anilino-3-methyl-6-dibutylaminofluoran (i.e., a coloring agent) and 3 parts of isocyanate (CORONATE HL, manufactured by Nippon Polyurethane Industry Co., Ltd.) to the thus obtained dispersion liquid while the mixture was well agitated.

The thermosensitive layer application liquid was applied to a white turbidity polyester film (TETRON® film U2L98W, manufactured by DuPont Teijin Films) having a thickness of 125 μm using a wire bar, and then dried for 2 minutes at 100° C., followed by heating at 60° C. for 24 hours. Thus, a thermosensitive layer having a thickness of about 11.0 μm was formed.

Preparation of Intermediate Layer

The following components were stirred well to prepare an intermediate layer application liquid.

| | |
|---|---|
| Acrylic polyol resin 50 weight % solution (LR327, manufactured by Mitsubishi Rayon Co., Ltd.) | 3 parts |
| Zinc oxide particulate 30 weight % dispersion solution (ZS303, manufactured by Sumitomo-Osaka Cement Co., Ltd.) | 7 parts |
| Isocyanate (CORONATE HL, manufactured by Nippon Polyurethane Industry Co., Ltd.) | 1.5 parts |
| Methylethyl ketone | 7 parts |

The thus obtained intermediate application liquid was applied to the thermosensitive layer using a wire bar, and then dried at 90° C. for 1 minute, followed by heating at 60° C. for 2 hours. Thus, an intermediate layer having a thickness of about 2.0 μm was formed on the thermosensitive layer.

Preparation of Protective Layer

The following components were well agitated with a ball mill to prepare a protective layer application liquid in which particles having an average particle diameter of about 3 μm was dispersed.

| | |
|---|---|
| Pentaerythritol hexacrylate (KAYARAD DPHA, manufactured by Nippon Kayaku Co., Ltd.) | 3 parts |
| Silica (P-526, manufactured by Mizusawa Industrial Chemicals Ltd.) | 1 part |
| Optical polyerimerization initialization agent (IRGACURE 184, manufactured by Nihon Ciba-Geigy KK.) | 0.5 parts |
| Isopropyl alcohol | 11 parts |

The thus prepared protective layer application liquid was coated on the intermediate layer using a wire bar, and then dried at 90° C. for 1 minute. Thereafter, the resultant was cross-linked under an ultraviolet ray lamp with an irradiation energy of 80 W/cm to form a protective layer having a thickness of about 3 μm on the intermediate layer.

A reversible thermosensitive recording medium of Example 1 was thus prepared.

Example 2

Manufacturing of Thermosensitive Recording Medium

The reversible thermosensitive recording medium of Example 2 was manufactured in the same manner as in Example 1 except that the composition of the thermosensitive layer was changed as follows:

Preparation of Thermosensitive Layer

The following components were pulverized and dispersed to obtain particles having an average particle diameter of 1.0 μm with a ball mill.

| | |
|---|---|
| Coloring developer represented by the following chemical structural formula 26 | 4 parts |
| Dialkylurea (HAKREEN SB, manufactured by Nippon Kasei Chemical Co., Ltd.) | 1 part |
| Acrylic polyol resin 40 weight % solution (LR327, manufactured by Mitsubishi Rayon Co., Ltd.) | 10 parts |
| Phenol based anti-oxidation agent (IRAGANOX 565, manufactured by Ciba Specialty Chemicals) represented by the following chemical formula 27 | 0.06 parts |
| Methylethyl ketone | 80 parts |

Coloring developer

[Chemical formula 26]

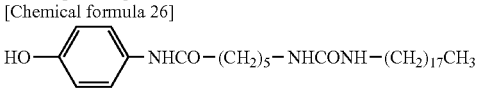

-continued

<IRGANOX 565>
[Chemical formula 27]

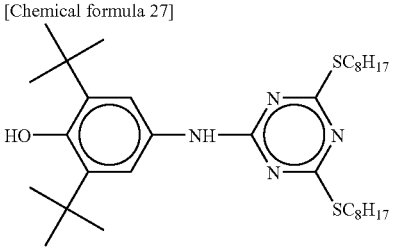

A thermosensitive layer application liquid was prepared by adding 1 part of 2-anilino-3-methyl-6-dibutylaminofluoran (i.e., a coloring agent) and 3 parts of isocyanate (CORONATE HL, manufactured by Nippon Polyurethane Industry Co., Ltd.) to the thus obtained dispersion liquid while the mixture was well agitated.

Example 3

Manufacturing of Thermosensitive Recording Medium

The reversible thermosensitive recording medium of Example 3 was manufactured in the same manner as in Example 1 except that the composition of the intermediate layer was changed as follows:

Preparation of Intermediate Layer

The following components were stirred well to prepare an intermediate layer application liquid.

| | |
|---|---|
| Ultraviolet ray absorption polymer 40 weight % solution (UV-A11, manufactured by Nippon Shokubai Co., Ltd.) | 50 parts |
| Methylethylketone | 50 parts |

The thus obtained intermediate application liquid was applied to the thermosensitive layer using a wire bar, and then dried at 90° C. for 1 minute, followed by heating at 60° C. for 2 hours. Thus, an intermediate layer having a thickness of about 2.0 μm was formed on the thermosensitive layer.

Example 4

Manufacturing of Thermosensitive Recording Medium

The reversible thermosensitive recording medium of Example 4 was manufactured in the same manner as in Example 1 except that the composition of the intermediate layer was changed as follows:

Preparation of Intermediate Layer

The following components were stirred well to prepare an intermediate layer application liquid.

| | |
|---|---|
| Ultraviolet ray absorption polymer 40 weight % solution (UV-A11, manufactured by Nippon Shokubai Co., Ltd.) | 50 parts |
| Isocyanate (CORONATE HL, manufactured by Nippon Polyurethane Industry Co., Ltd.) | 7 parts |
| Methylethylketone | 43 parts |

The thus obtained intermediate application liquid was applied to the thermosensitive layer using a wire bar, and then dried at 90° C. for 1 minute, followed by heating at 60° C. for 2 hours. Thus, an intermediate layer having a thickness of about 2.0 μm was formed on the thermosensitive layer.

Example 5

Manufacturing of Thermosensitive Recording Medium

The reversible thermosensitive recording medium of Example 5 was manufactured in the same manner as in Example 1 except that the composition of the intermediate layer was changed as follows:

Preparation of Intermediate Layer

The following components were stirred well to prepare an intermediate layer application liquid.

| | |
|---|---|
| Ultraviolet ray absorption polymer 40 weight % solution (UV-A11, manufactured by Nippon Shokubai Co., Ltd.) | 50 parts |
| Isocyanate (CORONATE HL, manufactured by Nippon Polyurethane Industry Co., Ltd.) | 7 parts |
| Ultraviolet ray absorption agent (Eversorb 73, manufactured by Everlight Chemical Industrial Corporation) | 3.5 parts |
| Methylethylketone | 43 parts |

The thus obtained intermediate application liquid was applied to the thermosensitive layer using a wire bar, and then dried at 90° C. for 1 minute, followed by heating at 60° C. for 2 hours. Thus, an intermediate layer having a thickness of about 2.0 μm was formed on the thermosensitive layer.

Example 6

Manufacturing of Thermosensitive Recording Medium

The reversible thermosensitive recording medium of Example 6 was manufactured in the same manner as in Example 5 except that the composition of the thermosensitive layer was changed as follows:

Preparation of Thermosensitive Layer

The following components were pulverized and dispersed to obtain particles having an average particle diameter of 1.0 μm with a ball mill.

| | |
|---|---|
| Coloring developer represented by the following chemical structural formula 28 | 4 parts |
| Dialkylurea (HAKREEN SB, manufactured by Nippon Kasei Chemical Co., Ltd.) | 1 part |
| Acrylic polyol resin 40 weight % solution (LR327, manufactured by Mitsubishi Rayon Co., Ltd.) | 10 parts |
| Phenol based anti-oxidation agent (IRAGANOX 565, manufactured by Ciba Specialty Chemicals) represented by the following chemical formula 29 | 0.06 parts |
| Methylethyl ketone | 80 parts |

Coloring developer
[Chemical formula 28]

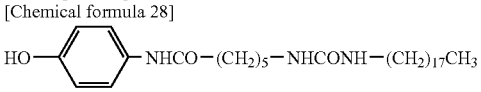

IRGANOX 565
Chemical formula 29

-continued

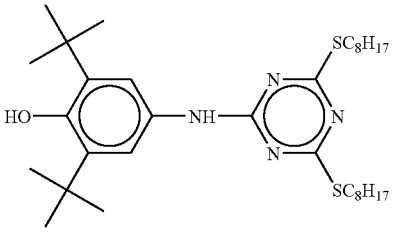

A thermosensitive layer application liquid was prepared by adding 1 part of 2-anilino-3-methyl-6-dibutylaminofluoran (i.e., a coloring agent) and 3 parts of isocyanate (CORONATE HL, manufactured by Nippon Polyurethane Industry Co., Ltd.) to the thus obtained dispersion liquid while well agitating the mixture.

Example 7

Manufacturing of Thermosensitive Recording Medium

The reversible thermosensitive recording medium of Example 7 was manufactured in the same manner as in Example 6 except that the content of the phenol based anti-oxidation agent (IRAGANOX 565, manufactured by Ciba Specialty Chemicals) was changed from 0.15 to 1.2 parts.

Example 8

Manufacturing of Thermosensitive Recording Medium

The reversible thermosensitive recording medium of Example 8 was manufactured in the same manner as in Example 7 except that, before forming the thermosensitive layer, the intermediate layer and the protective layer, the following undercoat layer having a thickness of about 20 μm was formed on the white turbidity polyester film (TETRON® film U2L98W, manufactured by DuPont Teijin Films) having a thickness of 125 μm using a wire bar, and then dried at 80° C. for 2 minutes.

Preparation of Undercoat Layer

The following component was uniformly dispersed while stirring for about one hour to obtain an undercoat layer application liquid:

| | |
|---|---|
| Styrene-butadiene based copolymer (PA-9159, manufactured by Nippon A & L INC.) | 30 parts |
| Polyvinylalcohol (POVAL PVA 103, manufactured by Kuraray Co., Ltd.) | 12 parts |
| Hollow particles (MICROSPHERE R-300, manufactured by Matsumoto Yushi-Seiyaku Co., Ltd.) | 20 parts |
| Water | 40 parts |

Example 9

Manufacturing of Thermosensitive Recording Medium

The reversible thermosensitive recording medium of Example 9 was manufactured in the same manner as in Example 1 except that the coloring developer was changed to the compound represented by the following chemical structural formula.

[Chemical formula 30]

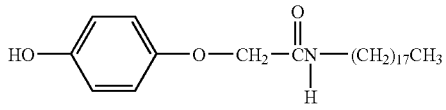

Example 10

Manufacturing of Thermosensitive Recording Medium

The reversible thermosensitive recording medium of Example 10 was manufactured in the same manner as in Example 1 except that the coloring developer was changed to the compound represented by the following chemical structural formula.

[Chemical formula 31]

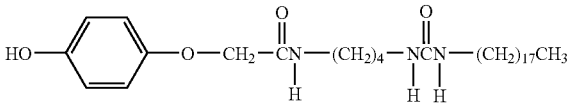

Example 11

Manufacturing of Thermosensitive Recording Medium

The reversible thermosensitive recording medium of Example 11 was manufactured in the same manner as in Example 8 except that the coloring developer was changed to the compound represented by the following chemical structural formula.

[Chemical formula 32]

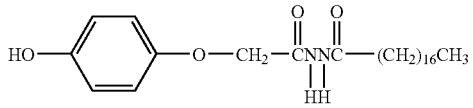

Comparative Example 1

Manufacturing of Reversible Thermosensitive Recording Medium

The reversible thermosensitive recording medium of Comparative Example 1 was manufactured in the same manner as in Example 1 except that the Phenol based anti-oxidation agent (IRAGANOX 1520, manufactured by Ciba Specialty Chemicals) was removed.

Comparative Example 2

Manufacturing of Reversible Thermosensitive Recording Medium

The reversible thermosensitive recording medium of Comparative Example 2 was manufactured in the same manner as in Example 7 except that the phenol based anti-oxidation agent (IRAGANOX 565, manufactured by Ciba Specialty Chemicals) was removed.

Comparative Example 3

Manufacturing of Reversible Thermosensitive Recording Medium

The reversible thermosensitive recording medium of Comparative Example 3 was manufactured in the same manner as in Example 7 except that the phenol based anti-oxidation agent (IRAGANOX 1520, manufactured by Ciba Specialty Chemicals) was changed to the phenol based anti-oxidation agent (IRAGANOX 1076, manufactured by Ciba Specialty Chemicals) represented by the following chemical formula 33 IRGANOX 1076

[Chemical formula 33]

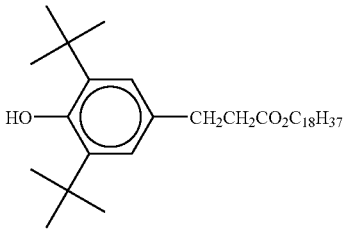

Comparative Example 4

Manufacturing of Reversible Thermosensitive Recording Medium

The reversible thermosensitive recording medium of Comparative Example 4 was manufactured in the same manner as in Example 7 except that the phenol based anti-oxidation agent (IRAGANOX 1520, manufactured by Ciba Specialty Chemicals) was changed to the anti-oxidation agent (AO-503, manufactured by Asahi Denka Co., Ltd.) represented by the following chemical formula 34.

AO-503

$S—(CH_2CH_2CO_2C_{13}H_{27})_2$ [Chemical Formula 34]

Comparative Example 5

Manufacturing of Reversible Thermosensitive Recording Medium

The reversible thermosensitive recording medium of Comparative Example 5 was manufactured in the same manner as in Example 7 except that the phenol based anti-oxidation agent (IRAGANOX 1520, manufactured by Ciba Specialty Chemicals) was changed to the anti-oxidation agent represented by the following chemical formula 35.

4,4-thiobis(3-methyl-6-t-butylphenol)

[Chemical formula 35]

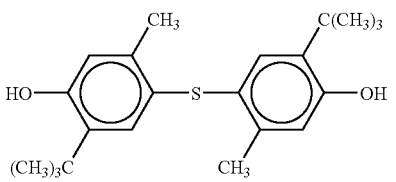

Next, each manufactured reversible thermosensitive recording medium was tested for the background density, print sensitivity, erasure of characters after repetitive printing, and light durability. The results are shown in Table 1.

Background Density

Image density on the background portion of each manufactured reversible thermosensitive recording medium was measured using Macbeth densitometer R914.

Print Sensitivity

An image having 16 gradation level with 0.27 to 0.66 mj/dot using a printing device manufactured by BeCom Co., Ltd. while varying energy based on voltage variance (8.0 to 15.5 V) having a constant pulse width of 2.94 msec was formed on each manufactured reversible thermosensitive recording medium. The formed image was measured by the Macbeth densitometer R914 to calculate the energy value applied when the density was saturated.

Erasure of Characters After Repetitive Printing

Images were formed and erased on each manufactured reversible thermosensitive recording medium 100 times using a card printer (R28000, manufactured by PCC Co., Ltd.). Thereafter, the surface of each medium was observed with naked eyes and evaluated based on the following evaluation criterion.

[Evaluation Criterion]

E: Excellent (Surface free from scars and scratches)

F: Fair (Scars and scratches observed on the surface)

P: Poor (Major scars and scratches observed and the surface damaged)

Light Durability

An image was formed on each medium using a card printer (R28000, manufactured by PCC Co., Ltd.) and left for 300 hours under light of 5,000 Lux. Thereafter, the entire image was erased by the card printer. The color tone variance (color difference on non-printed portion (background portion) before and after irradiation of the light) was evaluated using an X lightometer. The portion incompletely decolorized (image formed portion before irradiation) was evaluated using the Macbeth densitometer R914. The color difference on the background portion and the degree of incomplete decolorization were calculated based on the following mathematical expressions:

Color difference ($\Delta E$)=$\sqrt{}$(before irradiation $L^*$−after irradiation $L^*)^2$+(before irradiation $a^*$−after irradiation $a^*)^2$+(before irradiation $b^*$−after irradiation $b^*)^2$ [Mathematical Expression 1]

Incomplete decolorization=(the density of the erased image portion after irradiation)−(the density of the background after irradiation) [Mathematical Expression 2]

TABLE 1

| | Background density | Color difference of background portion (ΔE) | Incomplete decolorization | Erasure of characters after repetitive printing | Print sensitivity (mj/dot) |
|---|---|---|---|---|---|
| Example 1 | 0.10 | 4.2 | 0.05 | E | 0.58 |
| Example 2 | 0.18 | 4.0 | 0.045 | E | 0.58 |
| Example 3 | 0.10 | 3.5 | 0.04 | E | 0.52 |
| Example 4 | 0.09 | 3.2 | 0.04 | E | 0.52 |
| Example 5 | 0.10 | 2.3 | 0.038 | E | 0.52 |
| Example 6 | 0.11 | 1.8 | 0.035 | E | 0.52 |

TABLE 1-continued

| | Back-ground density | Color difference of background portion (ΔE) | Incom-plete decolor-ization | Erasure of characters after repetitive printing | Print sensitivity (mj/dot) |
|---|---|---|---|---|---|
| Example 7 | 0.11 | 1.7 | 0.031 | E | 0.52 |
| Example 8 | 0.10 | 1.7 | 0.03 | E | 0.39 |
| Example 9 | 0.12 | 4.1 | 0.03 | E | 0.54 |
| Example 10 | 0.13 | 4.0 | 0.05 | E | 0.52 |
| Example 11 | 0.12 | 1.8 | 0.04 | E | 0.56 |
| Comparative Example 1 | 0.09 | 5.8 | 0.108 | E | 0.58 |
| Comparative Example 2 | 0.10 | 4.8 | 0.092 | E | 0.52 |
| Comparative Example 3 | 0.10 | 4.5 | 0.07 | E | 0.52 |
| Comparative Example 4 | 0.11 | 4.8 | 0.075 | E | 0.52 |
| Comparative Example 5 | 0.09 | 5.0 | 0.065 | E | 0.52 |

This document claims priority and contains subject matter related to Japanese Patent Application No. 2004-319797, filed on 2 Nov. 2004, the entire contents of which are incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. A reversible thermosensitive recording medium, comprising:

a substrate; and a thermosensitive layer, comprising:

an electron donating coloring compound;

an electron accepting compound; and a phenol anti-oxidation agent comprising one or more sulfur atoms comprising an alkyl group on one side, wherein the thermosensitive layer reversibly changes its color tone depending on temperature to reversibly record and erase an image thereon;

wherein the phenol anti-oxidation agent is represented by a compound represented by the chemical structural formula (1):

(1)

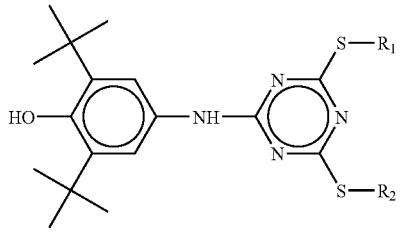

wherein $R_1$ and $R_2$ independently represent an alkyl group; and wherein a content of the phenol anti-oxidation agent occupies 1 to 10 weight % based on a weight of the thermosensitive layer.

2. The reversible thermosensitive recording medium according to claim 1, wherein the electron accepting compound is represented by the following chemical structural formula (3):

(3)

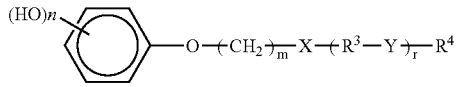

wherein n represents an integer of from 1 to 3, m represents an integer of from 1 to 20, r represents an integer of from 0 to 3, X and Y each represents a divalent group comprising hetero atoms, $R^3$ represents a divalent hydrocarbon group, and $R^4$ represents a univalent hydrocarbon group.

3. The reversible thermosensitive recording medium according to claim 1, wherein a layer comprising a polymer having a structure of absorbing ultraviolet rays is provided on the thermosensitive layer.

4. The reversible thermosensitive recording medium according to claim 3, wherein the polymer in the layer comprising a polymer having a structure of absorbing ultraviolet rays is cross-linked.

5. The reversible thermosensitive recording medium according to claim 1, further comprising an ultraviolet ray absorbing agent.

6. The reversible thermosensitive recording medium according to claim 5, wherein the layer comprising a polymer having a structure of absorbing ultraviolet rays comprises the ultraviolet ray absorbing agent.

7. The reversible thermosensitive recording medium according to claim 1, wherein an undercoat layer is provided between the substrate and the thermosensitive layer.

8. The reversible thermosensitive recording medium according to claim 1, wherein the undercoat layer comprises hollow particles.

9. The reversible thermosensitive recording medium according to claim 1, wherein the reversible thermosensitive recording medium is processed to have a card form, a label form, a sheet form, or a roll form.

10. The reversible thermosensitive recording medium according to claim 1, wherein at least one of the side on which an image is formed and the other side thereof comprises at least one of an irreversible visible information portion and an irreversible printable portion.

11. A reversible thermosensitive recording label, comprising:

the reversible thermosensitive recording medium of claim 1; and an adhesive layer disposed on a side of the reversible thermosensitive recording medium on which an image is not formed.

12. A reversible thermosensitive recording device, comprising:

an information storage portion; and a reversible display portion comprising the reversible thermosensitive recording medium of claim 1.

13. The reversible thermosensitive recording device according to claim 12, wherein the information storage portion and the reversible display portion are integrated.

14. The reversible thermosensitive recording device according to claim 12, wherein the information storage portion comprises one of a magnetically thermosensitive layer, a magnetic stripe, an IC memory, an optical memory, a hologram, an RF-ID tag card, a disc, a disc cartridge, and a cassette tape.

15. An image processing apparatus, comprising:

at least one of an image forming device configured to form an image on the reversible thermosensitive recording medium of claim 1 by heating the reversible thermosensitive medium, and an image erasing device configured to erase the image formed on the reversible thermosensitive medium by heating the reversible thermosensitive medium.

16. The image processing apparatus according to claim 15, wherein the image processing device is one of a thermal head and a laser irradiation device.

17. The image processing apparatus according to claim 15, wherein the image erasing device is one of a thermal head, a ceramic heater, a heat roll, a hot stamp, a heat block, and a laser irradiation device.

18. An image processing method, comprising:

at least one of forming an image on the reversible thermosensitive recording medium of claim 1 by heating the reversible thermosensitive recording medium and erasing the image formed on the reversible thermosensitive recording medium by heating the reversible thermosensitive recording medium.

19. The image processing method according to claim 18, wherein image formation is performed by one of a thermal printhead and a laser irradiation device.

20. The image processing method according to claim 19, wherein an image is formed on the reversible thermosensitive recording medium while erasing a previously formed image using a thermal printhead.

21. The image processing method according to claim 18, wherein image erasure is performed by one of a thermal printhead, a ceramic heater, a heat roll, a hot stamp, a heat block, and a laser irradiation device.

* * * * *